US008779687B2

(12) United States Patent
Harbers

(10) Patent No.: US 8,779,687 B2
(45) Date of Patent: Jul. 15, 2014

(54) CURRENT ROUTING TO MULTIPLE LED CIRCUITS

(71) Applicant: Xicato, Inc., San Jose, CA (US)

(72) Inventor: Gerard Harbers, Sunnyvale, CA (US)

(73) Assignee: Xicato, Inc., San Jose, CA (US)

( * ) Notice: Subject to any disclaimer, the term of this patent is extended or adjusted under 35 U.S.C. 154(b) by 9 days.

(21) Appl. No.: 13/761,061

(22) Filed: Feb. 6, 2013

(65) Prior Publication Data

US 2013/0154490 A1 Jun. 20, 2013

Related U.S. Application Data

(60) Provisional application No. 61/598,212, filed on Feb. 13, 2012.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 37/00*** | (2006.01) |
| ***H05B 39/00*** | (2006.01) |
| ***H05B 41/00*** | (2006.01) |

(52) U.S. Cl.
USPC ..... 315/294; 315/312

(58) Field of Classification Search
None
See application file for complete search history.

(56) References Cited

U.S. PATENT DOCUMENTS

| | | | | |
|---|---|---|---|---|
| 5,959,316 | A | 9/1999 | Lowery | |
| 6,351,069 | B1 | 2/2002 | Lowery et al. | |
| 6,459,919 | B1 | 10/2002 | Lys et al. | |
| 6,504,301 | B1 | 1/2003 | Lowery | |
| 6,586,882 | B1 | 7/2003 | Harbers | |
| 6,600,175 | B1 | 7/2003 | Baretz et al. | |
| 6,680,569 | B2 | 1/2004 | Mueller-Mach et al. | |
| 6,812,500 | B2 | 11/2004 | Reeh et al. | |
| 7,126,162 | B2 | 10/2006 | Reeh et al. | |
| 7,250,715 | B2 | 7/2007 | Mueller et al. | |
| 7,288,902 | B1 * | 10/2007 | Melanson | 315/291 |
| 7,479,662 | B2 | 1/2009 | Soules et al. | |
| 7,564,180 | B2 | 7/2009 | Brandes | |
| 7,614,759 | B2 | 11/2009 | Negley | |
| 7,629,621 | B2 | 12/2009 | Reeh et al. | |

(Continued)

FOREIGN PATENT DOCUMENTS

| | | | |
|---|---|---|---|
| DE | 102008050643 | A1 | 4/2010 |
| WO | WO 2011/020007 | A1 | 2/2011 |

OTHER PUBLICATIONS

International Search Report and Written Opinion mailed on May 7, 2013 for PCT Application No. PCT/US2013/025179 filed on Feb. 7, 2013, 11 pages.

(Continued)

*Primary Examiner* — Douglas W Owens
*Assistant Examiner* — Dedei K Hammond
(74) *Attorney, Agent, or Firm* — Silicon Valley Patent Group LLP

(57) ABSTRACT

An illumination module includes a plurality of Light Emitting Diodes (LEDs) located in different zones to preferentially illuminate different color converting surfaces. The flux emitted from LEDs located in different zones may be independently controlled by selectively routing current from a single current source to different strings of LEDs in the different zones. In this manner, changes in the CCT of light emitted from LED based illumination module may be achieved.

21 Claims, 14 Drawing Sheets

(56) References Cited

U.S. PATENT DOCUMENTS

| | | | | |
|---|---|---|---|---|
| 8,179,058 | B1 * | 5/2012 | Campbell et al. | 315/291 |
| 2006/0208666 | A1 | 9/2006 | Johnson | |
| 2007/0081336 | A1 | 4/2007 | Bierhuizen et al. | |
| 2009/0187234 | A1 * | 7/2009 | Meyer et al. | 607/88 |
| 2009/0296384 | A1 | 12/2009 | Van De Ven et al. | |
| 2010/0315012 | A1 * | 12/2010 | Kim et al. | 315/185 R |
| 2010/0327762 | A1 | 12/2010 | Yang | |

OTHER PUBLICATIONS

Machine Translation in English of Abstract for DE102008050643 visited at <www.espacenet.com> on Jun. 14, 2013, 1 page.

* cited by examiner

300
| SWITCHING FREQUENCY | LED STRING 1 DUTY CYCLE | LED STRING 2 DUTY CYCLE |
|---|---|---|
| 5.2 KHZ | 90% | 40% |
| 5.1 KHZ | 80% | 50% |
| 5.0 KHZ | 70% | 60% |
| 4.9 KHZ | 60% | 70% |
| 4.8 KHZ | 50% | 80% |
FIG. 16
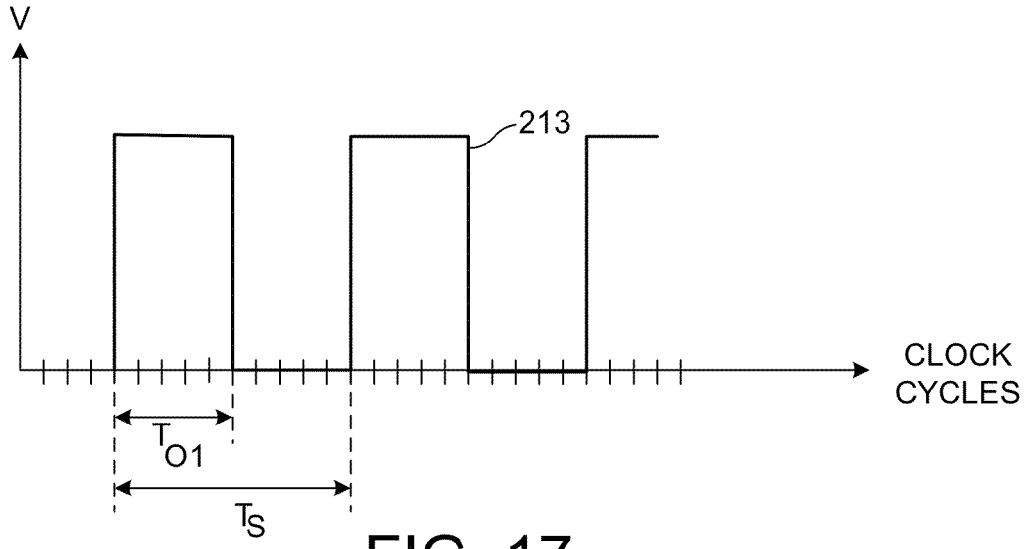
FIG. 17
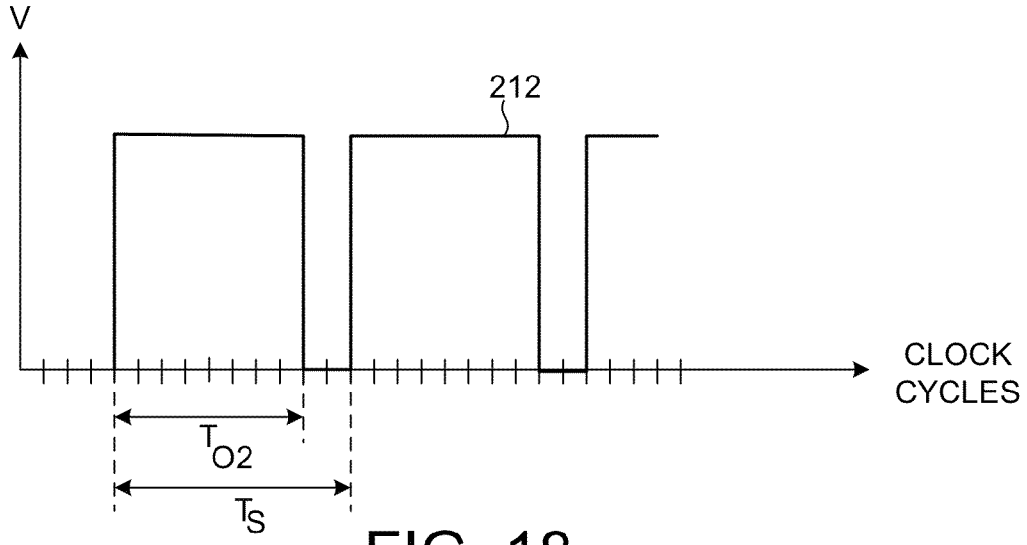
FIG. 18

CURRENT ROUTING TO MULTIPLE LED CIRCUITS

CROSS REFERENCE TO RELATED APPLICATIONS

This application claims priority under 35 USC 119 to U.S. Provisional Application No. 61/598,212, filed Feb. 13, 2012, which is incorporated by reference herein in its entirety.

TECHNICAL FIELD

The described embodiments relate to illumination modules that include Light Emitting Diodes (LEDs).

BACKGROUND

The use of light emitting diodes in general lighting is still limited due to limitations in light output level or flux generated by the illumination devices. Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a small selection of produced LEDs that meet the color and/or flux requirements for the application.

SUMMARY

An illumination module includes a plurality of Light Emitting Diodes (LEDs) located in different zones to preferentially illuminate different color converting surfaces. The flux emitted from LEDs located in different zones may be independently controlled by selectively routing current from a single current source to different strings of LEDs in the different zones. In this manner, changes in the CCT of light emitted from LED based illumination module may be achieved.

In one implementation, an LED based illumination device includes a first LED string comprising a first plurality of LEDs coupled in series, wherein a current supplied to the first LED string causes a light emission from the LED based illumination device with a first Correlated Color Temperature (CCT); a second LED string comprising a second plurality of LEDs coupled in series, wherein the current supplied to the second LED string causes a light emission from the LED based illumination device with a second CCT; and a current router comprising, a first node coupled to a current source, the current router operable to receive a current signal on the first node, a second node coupled to the first LED string, a third node coupled to the second LED string, the current router operable to selectively route a first portion of the current signal to the first LED string over the second node and a second portion of the current signal to the second LED string over the third node based on a property of the current signal.

In one implementation, an apparatus includes a current source having a power input node, a color command input node, and a power output node, wherein the current source is operable to change a switching frequency of a current signal generated by the current source on the output node based on a color command input signal on the color command input node; a current router having an input node, a first output node, and a second output node, the input node of the current router coupled to the power output node of the current source; a first plurality of LEDs coupled in series between the first output node of the current router and the power input node of the current source; and a second plurality of LEDs coupled in series between the second output node of the current router and the power input node of the current source.

In one implementation, a current router includes a first node couplable to a single channel of a current source, wherein the current source is a switching power supply operable at a plurality of switching frequencies; a second node couplable to a first LED string including a first plurality of LEDs coupled in series; and a third node couplable to a second LED string including a second plurality of LEDs coupled in series, wherein a current signal received by the current router over the first node is selectively routed to each of the first string of LEDs and the second string of LEDs based on a switching frequency of the switching power supply.

In one implementation, a method includes receiving a switched current signal having a switching frequency; and selectively routing a first portion of the switched current signal to a first plurality of LEDs coupled in series and a second portion of the switched current signal to a second plurality of LEDs coupled in series based on the switching frequency.

Further details and embodiments and techniques are described in the detailed description below. This summary does not define the invention. The invention is defined by the claims.

BRIEF DESCRIPTION OF THE DRAWINGS

FIG. 16 is illustrative of a look-up table that may be employed with the current router of FIG. 15 to determine the duty cycle associated with each LED string as a function of the switching frequency of current signal.

FIGS. 17 and 18 illustrate possible control signals communicated by the microcontroller to a switching element in the current router of FIG. 15.

DETAILED DESCRIPTION

Reference will now be made in detail to background examples and some embodiments of the invention, examples of which are illustrated in the accompanying drawings.

Figure 1:
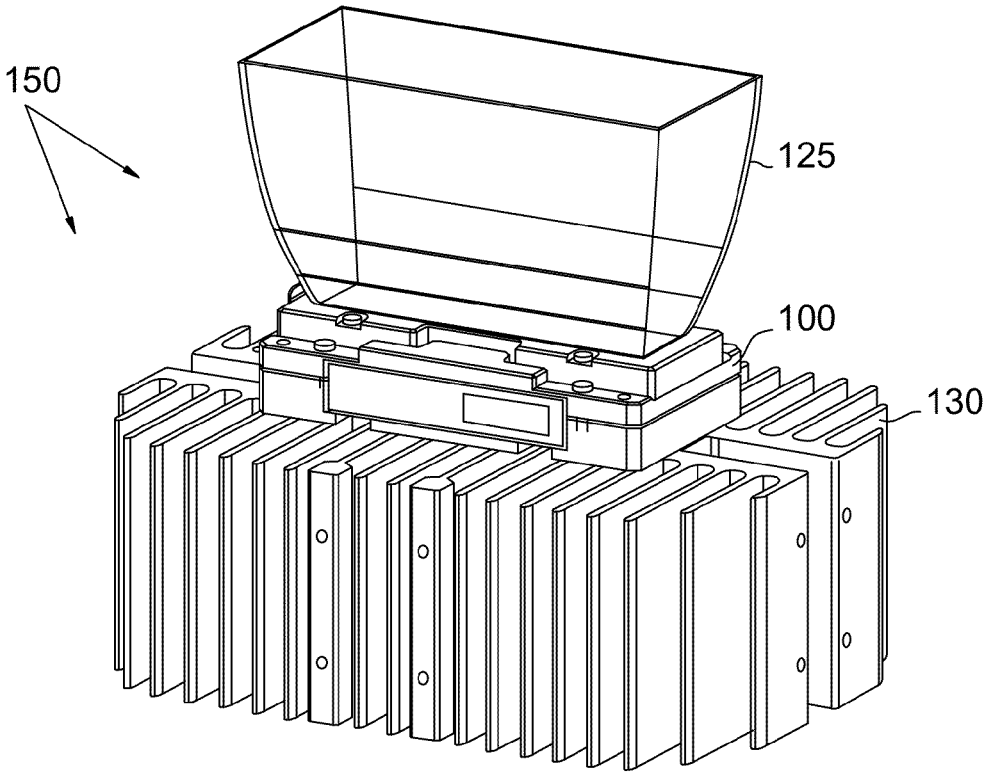
FIGS. 1, 2, and 3 illustrate three exemplary luminaires, including an illumination device, optical element, and light fixture.
Figure 2:
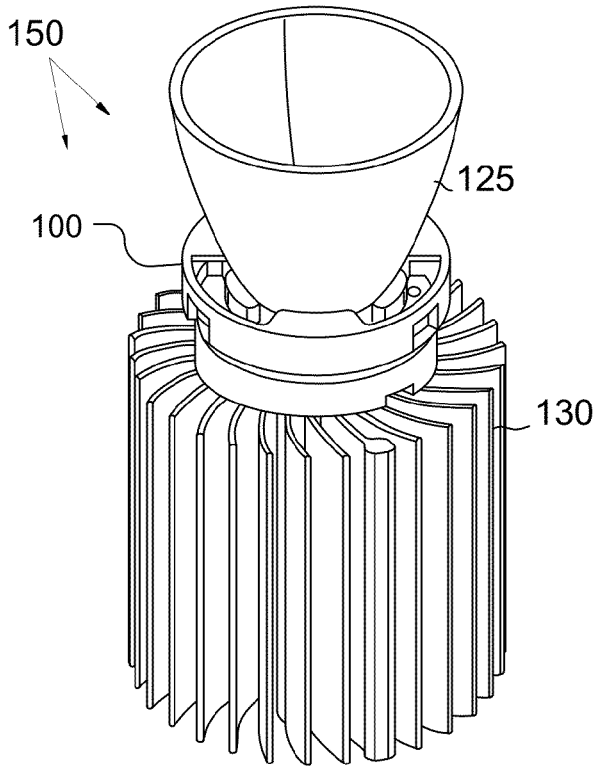
Figure 3:
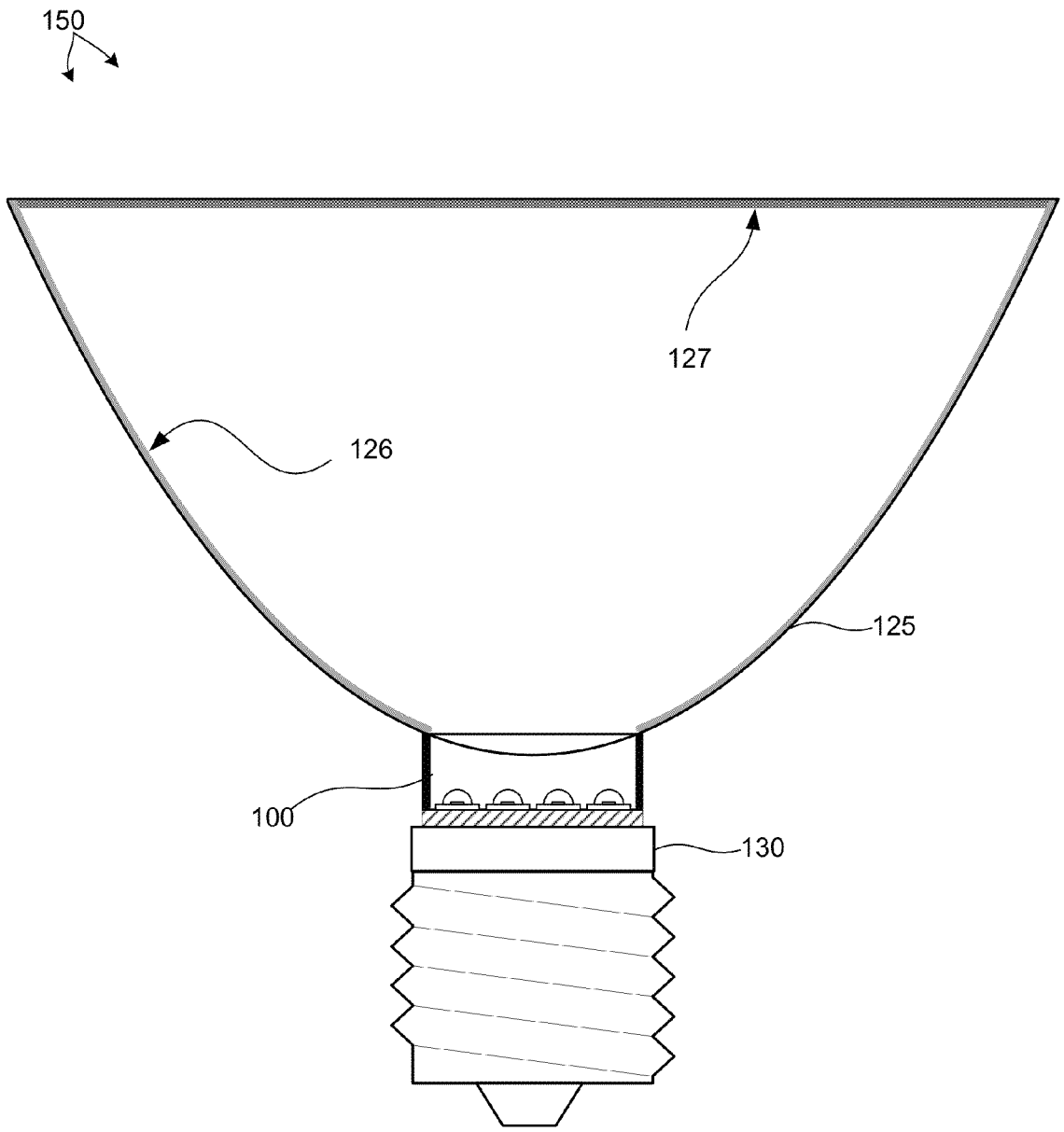

FIGS. 1, 2, and 3 illustrate three exemplary luminaires, all labeled 150. The luminaire illustrated in FIG. 1 includes an illumination module 100 with a rectangular form factor. The luminaire illustrated in FIG. 2 includes an illumination module 100 with a circular form factor. The luminaire illustrated in FIG. 3 includes an illumination module 100 integrated into a retrofit lamp device. These examples are for illustrative purposes. Examples of illumination modules of general polygonal and elliptical shapes may also be contemplated. Luminaire 150 includes illumination module 100, reflector 125, and light fixture 130. As depicted, light fixture 130 includes a heat sink capability, and therefore may be sometimes referred to as heat sink 130. However, light fixture 130 may include other structural and decorative elements (not shown). Reflector 125 is mounted to illumination module 100 to collimate or deflect light emitted from illumination module 100. The reflector 125 may be made from a thermally conductive material, such as a material that includes aluminum or copper and may be thermally coupled to illumination module 100. Heat flows by conduction through illumination module 100 and the thermally conductive reflector 125. Heat also flows via thermal convection over the reflector 125. Reflector 125 may be a compound parabolic concentrator, where the concentrator is constructed of or coated with a highly reflecting material. Optical elements, such as a diffuser or reflector 125 may be removably coupled to illumination module 100, e.g., by means of threads, a clamp, a twist-lock mechanism, or other appropriate arrangement. As illustrated in FIG. 3, the reflector 125 may include sidewalls 126 and a window 127 that are optionally coated, e.g., with a wavelength converting material, diffusing material or any other desired material.

As depicted in FIGS. 1, 2, and 3, illumination module 100 is mounted to heat sink 130. Heat sink 130 may be made from a thermally conductive material, such as a material that includes aluminum or copper and may be thermally coupled to illumination module 100. Heat flows by conduction through illumination module 100 and the thermally conductive heat sink 130. Heat also flows via thermal convection over heat sink 130. Illumination module 100 may be attached to heat sink 130 by way of screw threads to clamp the illumination module 100 to the heat sink 130. To facilitate easy removal and replacement of illumination module 100, illumination module 100 may be removably coupled to illumination module 100, e.g., by means of a clamp mechanism, a twist-lock mechanism, or other appropriate arrangement. Illumination module 100 includes at least one thermally conductive surface that is thermally coupled to heat sink 130, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 130 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination module 100.

Figure 4:
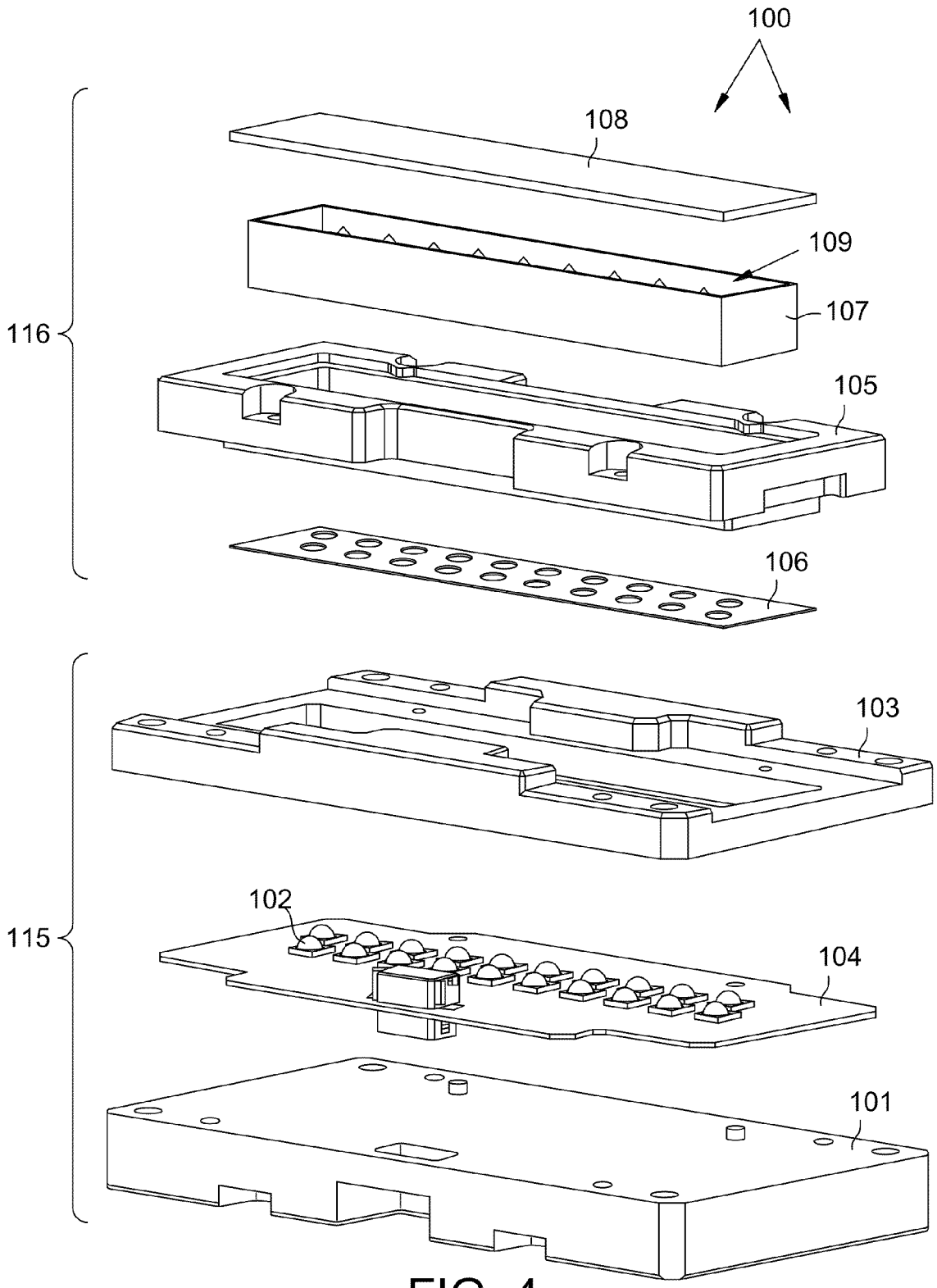
FIG. 4 illustrates an exploded view of components of the LED based illumination module depicted in FIG. 1.

FIG. 4 illustrates an exploded view of components of LED based illumination module 100 as depicted in FIG. 1 by way of example. It should be understood that as defined herein an LED based illumination module is not an LED, but is an LED light source or fixture or component part of an LED light source or fixture. For example, an LED based illumination module may be an LED based replacement lamp such as depicted in FIG. 3. LED based illumination module 100 includes one or more LED die or packaged LEDs and a mounting board to which LED die or packaged LEDs are attached. In one embodiment, the LEDs 102 are packaged LEDs, such as the Luxeon Rebel manufactured by Philips Lumileds Lighting. Other types of packaged LEDs may also be used, such as those manufactured by OSRAM (Oslon package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and an output port, which is illustrated as, but is not limited to, an output window 108. Light conversion sub-assembly 116 may include a bottom reflector 106 and sidewall 107, which may optionally be formed from inserts. Output window 108, if used as the output port, is fixed to the top of cavity body 105. In some embodiments, output window 108 may be fixed to cavity body 105 by an adhesive. To promote heat dissipation from the output window to cavity body 105, a thermally conductive adhesive is desirable. The adhesive should reliably withstand the temperature present at the interface of the output window 108 and cavity body 105. Furthermore, it is preferable that the adhesive either reflect or transmit as much incident light as possible, rather than absorbing light emitted from output window 108. In one example, the combination of heat tolerance, thermal conductivity, and optical properties of one of several adhesives manufactured by Dow Corning (USA) (e.g., Dow Corning model number SE4420, SE4422, SE4486, 1-4173, or SE9210), provides suitable performance. However, other thermally conductive adhesives may also be considered.

Either the interior sidewalls of cavity body 105 or sidewall insert 107, when optionally placed inside cavity body 105, is reflective so that light from LEDs 102, as well as any wavelength converted light, is reflected within the cavity 160 until it is transmitted through the output port, e.g., output window 108 when mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 direct light from the LEDs 102 to the output window when cavity body 105 is mounted over light source sub-assembly 115. Although as depicted, the interior sidewalls of cavity body 105 are rectangular in shape as viewed from the top of illumination module 100, other shapes may be contemplated (e.g., clover shaped or polygonal). In addition, the interior sidewalls of cavity body 105 may taper or curve outward from mounting board 104 to output window 108, rather than perpendicular to output window 108 as depicted.

Bottom reflector insert 106 and sidewall insert 107 may be highly reflective so that light reflecting downward in the cavity 160 is reflected back generally towards the output port, e.g., output window 108. Additionally, inserts 106 and 107 may have a high thermal conductivity, such that it acts as an additional heat spreader. By way of example, the inserts 106 and 107 may be made with a highly thermally conductive material, such as an aluminum based material that is processed to make the material highly reflective and durable. By way of example, a material referred to as Miro®, manufactured by Alanod, a German company, may be used. High reflectivity may be achieved by polishing the aluminum, or by covering the inside surface of inserts 106 and 107 with one or more reflective coatings. Inserts 106 and 107 might alternatively be made from a highly reflective thin material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In other examples, inserts 106 and 107 may be made from a polytetrafluoroethylene (PTFE) material. In some examples inserts 106 and 107 may be made from a PTFE material of one to two millimeters thick, as sold by W.L. Gore (USA) and Berghof (Germany). In yet other embodiments, inserts 106 and 107 may be constructed from a PTFE material backed by a thin reflective layer such as a metallic layer or a non-metallic layer such as ESR, E60L, or MCPET. Also, highly diffuse reflective coatings can be applied to any of sidewall insert 107, bottom reflector insert 106, output window 108, cavity body 105, and mounting board 104. Such coatings may include titanium dioxide (TiO2), zinc oxide (ZnO), and barium sulfate (BaSO4) particles, or a combination of these materials.

Figure 5A:
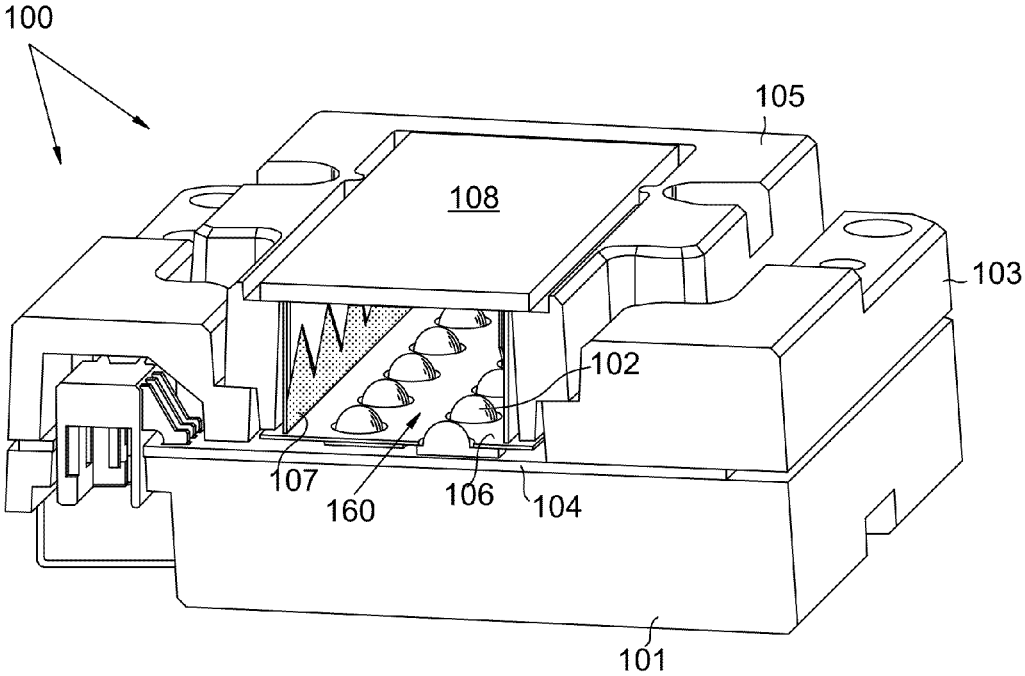
FIGS. 5A and 5B illustrate perspective, cross-sectional views of the LED based illumination module depicted in FIG. 1.
Figure 5B:
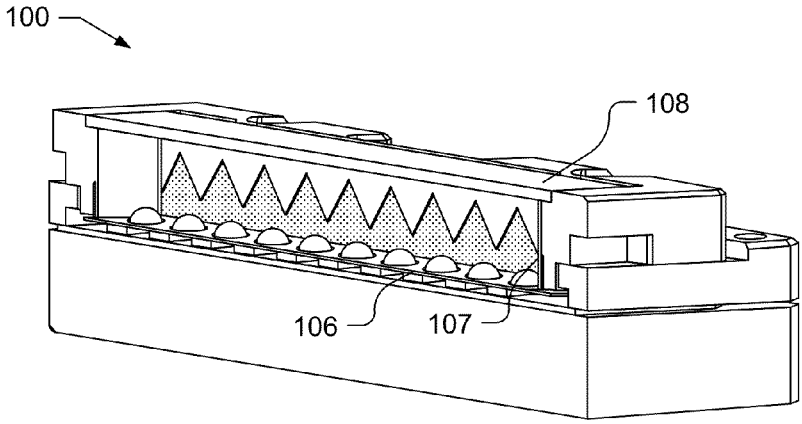

FIGS. 5A and 5B illustrate perspective, cross-sectional views of LED based illumination module 100 as depicted in FIG. 1. In this embodiment, the sidewall insert 107, output window 108, and bottom reflector insert 106 disposed on mounting board 104 define a color conversion cavity 160 (illustrated in FIG. 5A) in the LED based illumination module 100. A portion of light from the LEDs 102 is reflected within color conversion cavity 160 until it exits through output window 108. Reflecting the light within the cavity 160 prior to exiting the output window 108 has the effect of mixing the light and providing a more uniform distribution of the light that is emitted from the LED based illumination module 100. In addition, as light reflects within the cavity 160 prior to exiting the output window 108, an amount of light is color converted by interaction with a wavelength converting material included in the cavity 160.

LEDs 102 can emit different or the same colors, either by direct emission or by phosphor conversion, e.g., where phosphor layers are applied to the LEDs as part of the LED package. The illumination module 100 may use any combination of colored LEDs 102, such as red, green, blue, amber, or cyan, or the LEDs 102 may all produce the same color light. Some or all of the LEDs 102 may produce white light. In addition, the LEDs 102 may emit polarized light or non-polarized light and LED based illumination module 100 may use any combination of polarized or non-polarized LEDs. In some embodiments, LEDs 102 emit either blue or UV light because of the efficiency of LEDs emitting in these wavelength ranges. The light emitted from the illumination module 100 has a desired color when LEDs 102 are used in combination with wavelength converting materials included in color conversion cavity 160. The photo converting properties of the wavelength converting materials in combination with the mixing of light within cavity 160 results in a color converted light output. By tuning the chemical and/or physical (such as thickness and concentration) properties of the wavelength converting materials and the geometric properties of the coatings on the interior surfaces of cavity 160, specific color properties of light output by output window 108 may be specified, e.g., color point, color temperature, and color rendering index (CRI).

For purposes of this patent document, a wavelength converting material is any single chemical compound or mixture of different chemical compounds that performs a color conversion function, e.g., absorbs an amount of light of one peak wavelength, and in response, emits an amount of light at another peak wavelength.

Portions of cavity 160, such as the bottom reflector insert 106, sidewall insert 107, cavity body 105, output window 108, and other components placed inside the cavity (not shown) may be coated with or include a wavelength converting material. FIG. 5B illustrates portions of the sidewall insert 107 coated with a wavelength converting material. Furthermore, different components of cavity 160 may be coated with the same or a different wavelength converting material.

By way of example, phosphors may be chosen from the set denoted by the following chemical formulas: $Y_3Al_5O_{12}$:Ce, (also known as YAG:Ce, or simply YAG) $(Y,Gd)_3Al_5O_{12}$:Ce, CaS:Eu, SrS:Eu, $SrGa_2S_4$:Eu, $Ca_3(Sc,Mg)_2Si_3O_{12}$:Ce, $Ca_3Sc_2Si_3O_{12}$:Ce, $Ca_3Sc_2O_4$:Ce, $Ba_3Si_6O_{12}N_2$:Eu, (Sr,Ca)$AlSiN_3$:Eu, $CaAlSiN_3$:Eu, $CaAlSi(ON)_3$:Eu, $Ba_2SiO_4$:Eu, $Sr_2SiO_4$:Eu, $Ca_2SiO_4$:Eu, $CaSc_2O_4$:Ce, $CaSi_2O_2N_2$:Eu, $SrSi_2O_2N_2$:Eu, $BaSi_2O_2N_2Ca_5(PO_4)_3Cl$:EU, $Ba_5(PO_4)_3Cl$:EU, $Cs_2CaP_2O_7$, $Cs_2SrP_2O_7$, $Lu_3Al_5O_{12}$:Ce, $Ca_8Mg(SiO_4)_4Cl_2$:Eu, $Sr_8Mg(SiO_4)_4Cl_2$:Eu, $La_3Si_6N_{11}$:Ce, $Y_3Ga_5O_{12}$:Ce, $Gd_3Ga_5O_{12}$:Ce, $Tb_3Al_5O_{12}$:Ce, $Tb_3Ga_5O_{12}$:Ce, and $Lu_3Ga_5O_{12}$:Ce.

In one example, the adjustment of color point of the illumination device may be accomplished by replacing sidewall insert 107 and/or the output window 108, which similarly may be coated or impregnated with one or more wavelength converting materials. In one embodiment a red emitting phosphor such as a europium activated alkaline earth silicon nitride (e.g., (Sr,Ca)$AlSiN_3$:Eu) covers a portion of sidewall insert 107 and bottom reflector insert 106 at the bottom of the cavity 160, and a YAG phosphor covers a portion of the output window 108. In another embodiment, a red emitting phosphor such as alkaline earth oxy silicon nitride covers a portion of sidewall insert 107 and bottom reflector insert 106 at the bottom of the cavity 160, and a blend of a red emitting alkaline earth oxy silicon nitride and a yellow emitting YAG phosphor covers a portion of the output window 108.

In some embodiments, the phosphors are mixed in a suitable solvent medium with a binder and, optionally, a surfactant and a plasticizer. The resulting mixture is deposited by any of spraying, screen printing, blade coating, or other suitable means. By choosing the shape and height of the sidewalls that define the cavity, and selecting which of the parts in the cavity will be covered with phosphor or not, and by optimization of the layer thickness and concentration of the phosphor layer on the surfaces of color conversion cavity 160, the color point of the light emitted from the module can be tuned as desired.

In one example, a single type of wavelength converting material may be patterned on the sidewall, which may be, e.g., the sidewall insert 107 shown in FIG. 5B. By way of example, a red phosphor may be patterned on different areas of the sidewall insert 107 and a yellow phosphor may cover the output window 108. The coverage and/or concentrations of the phosphors may be varied to produce different color temperatures. It should be understood that the coverage area of the red and/or the concentrations of the red and yellow phosphors will need to vary to produce the desired color temperatures if the light produced by the LEDs 102 varies. The color performance of the LEDs 102, red phosphor on the sidewall insert 107 and the yellow phosphor on the output window 108 may be measured before assembly and selected based on performance so that the assembled pieces produce the desired color temperature.

Changes in CCT over the full range of achievable flux levels of an LED based illumination module 100 may be achieved by employing LEDs located in different zones that preferentially illuminate different color converting surfaces. In one aspect, the flux emitted from LEDs located in different zones may be independently controlled by selectively routing current from a single current source to different strings of LEDs in different zones. In this manner, changes in the CCT of light emitted from LED based illumination module 100 may be achieved. In some examples, changes of more than 300 Kelvin, over the full flux range may be achieved. In some other examples, changes of more than 500K may be achieved.

Figure 6:
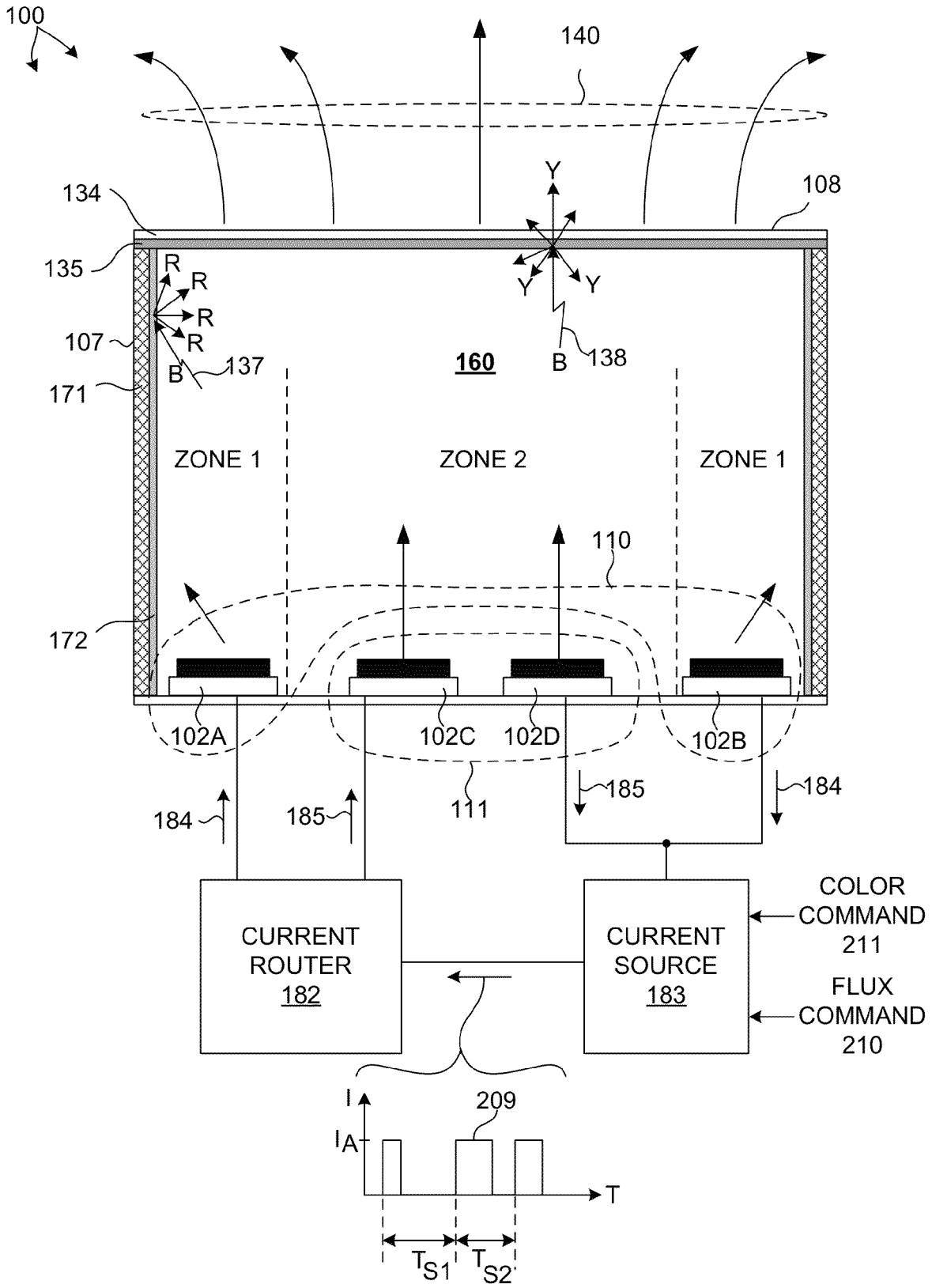
FIG. 6 is illustrative of a cross-sectional, side view of an LED based illumination module with LEDs coupled in series in different preferential zones and separately controlled by a current source and current router.

FIG. 6 is illustrative of a cross-sectional, side view of an LED based illumination module 100 in one embodiment. As illustrated, LED based illumination module 100 includes a plurality of LEDs 102A-102D, a sidewall 107 and an output window 108. Sidewall 107 includes a reflective layer 171 and a color converting layer 172. Color converting layer 172 includes a wavelength converting material (e.g., a red-emitting phosphor material). Output window 108 includes a transmissive layer 134 and a color converting layer 135. Color converting layer 135 includes a wavelength converting material with a different color conversion property than the wavelength converting material included in sidewall 107 (e.g., a yellow-emitting phosphor material). Color conversion cavity 160 is formed by the interior surfaces of the LED based illumination module 100 including the interior surface of sidewall 107 and the interior surface of output window 108.

The LEDs 102A-102D of LED based illumination module 100 emit light directly into color conversion cavity 160. Light is mixed and color converted within color conversion cavity 160 and the resulting combined light 140 is emitted by LED based illumination module 100. LEDs 102A and 102B are coupled in series and comprise LED string 110. LEDs 102C and 102D are coupled in series and comprise LED string 111.

Current source 183 supplies current to LED strings 110 and 111 that include LEDs coupled in series in preferential zones 1 and 2, respectively. In the example depicted in FIG. 6, current source 183 supplies current signal 209 to current router 182. Current signal 209 is a pulsed signal with varying switching frequency. For example, as illustrated in FIG. 6, current signal 209 includes a first pulse characterized by a first switching period, $T_{s1}$, and a second pulse characterized by a different switching period, $T_{s2}$. Current source 183 generates current signal 209 based on a flux command input signal 210 and a color command input signal 211. For example, in a pulse width modulation (PWM) scheme, current source 183 determines the pulse duration of each pulse of current signal 209 based on the value of the flux command input signal 210. In another example, in a pulse amplitude modulation (PAM) scheme, current source 183 determines the amplitude of each pulse of current signal 209 based on the value of the flux command input signal 210. In addition, current source 183 determines the switching period of each pulse of current signal 209 based on the value of the color command input signal 211. For example, as the color command input signal 211 trends to a lower value, the switching period of each pulse of current signal 209 is increased by current source 183. Conversely, as the color command input signal 211 trends to a higher value, the switching period of each pulse of current signal 209 is decreased by current source 183.

Current router 182 receives current signal 209 and selectively routes current signal 209 between LED strings 110 and 111 based on the switching period of current signal 209. In this manner, current router 182 supplies current signal 184 to LED string 110 and current signal 185 to LED string 111. Based on the absolute values of current supplied to LED string 110 and LED string 111, the output flux of combined light 140 is determined. Based on the relative values of current supplied to LED string 110 and LED string 111, the CCT of combined light 140 is determined.

By selectively routing the current supplied to LEDs 102 among LEDs located in different preferential zones, the correlated color temperatures (CCT) of combined light 140 output by LED based illumination module may be adjusted over a broad range of CCTs. For example, the range of achievable CCTs may exceed 300 Kelvin. In other examples, the range of achievable CCTs may exceed 500 Kelvin. In yet another example, the range of achievable CCTs may exceed 1,000 Kelvin. In some examples, the achievable CCT may be less than 2,000 Kelvin.

In one aspect, LEDs 102 included in LED based illumination module 100 are located in different zones that preferentially illuminate different color converting surfaces of color conversion cavity 160. For example, as illustrated, some LEDs 102A and 102B are located in zone 1. Light emitted from LEDs 102A and 102B located in zone 1 preferentially illuminates sidewall 107 because LEDs 102A and 102B are positioned in close proximity to sidewall 107. In some embodiments, more than fifty percent of the light output by LEDs 102A and 102B is directed to sidewall 107. In some other embodiments, more than seventy five percent of the light output by LEDs 102A and 102B is directed to sidewall 107. In some other embodiments, more than ninety percent of the light output by LEDs 102A and 102B is directed to sidewall 107.

As illustrated, some LEDs 102C and 102D are located in zone 2. Light emitted from LEDs 102C and 102D in zone 2 is directed toward output window 108. In some embodiments, more than fifty percent of the light output by LEDs 102C and 102D is directed to output window 108. In some other embodiments, more than seventy five percent of the light output by LEDs 102C and 102D is directed to output window 108. In some other embodiments, more than ninety percent of the light output by LEDs 102C and 102D is directed to output window 108.

In one embodiment, light emitted from LEDs located in preferential zone 1 is directed to sidewall 107 that may include a red-emitting phosphor material, whereas light emitted from LEDs located in preferential zone 2 is directed to output window 108 that may include a green-emitting phosphor material and a red-emitting phosphor material. By adjusting the current 184 supplied to LEDs located in zone 1 relative to the current 185 supplied to LEDs located in zone 2, the amount of red light relative to green light included in combined light 140 may be adjusted. In addition, the amount of blue light relative to red light is also reduced because the a larger amount of the blue light emitted from LEDs 102 interacts with the red phosphor material of color converting layer 172 before interacting with the green and red phosphor materials of color converting layer 135. In this manner, the probability that a blue photon emitted by LEDs 102 is converted to a red photon is increased as current 184 is increased relative to current 185. Thus, the selectively routement of current signal 209 between currents 184 and 185 may be used to tune the CCT of light emitted from LED based illumination module 100 from a relatively high CCT (e.g., approximately 3,000 Kelvin) to a relatively low CCT (e.g., approximately 2,000 Kelvin).

In some embodiments, LEDs 102A and 102B in zone 1 may be selected with emission properties that interact efficiently with the wavelength converting material included in sidewall 107. For example, the emission spectrum of LEDs 102A and 102B in zone 1 and the wavelength converting material in sidewall 107 may be selected such that the emission spectrum of the LEDs and the absorption spectrum of the wavelength converting material are closely matched. This ensures highly efficient color conversion (e.g., conversion to red light). Similarly, LEDs 102C and 102D in zone 2 may be selected with emission properties that interact efficiently with the wavelength converting material included in output window 108. For example, the emission spectrum of LEDs 102C and 102D in zone 2 and the wavelength converting material in output window 108 may be selected such that the emission spectrum of the LEDs and the absorption spectrum of the wavelength converting material are closely matched. This ensures highly efficient color conversion (e.g., conversion to red and green light).

Furthermore, employing different zones of LEDs that each preferentially illuminates a different color converting surface minimizes the occurrence of an inefficient, two-step color conversion process. By way of example, a photon 138 generated by an LED (e.g., blue, violet, ultraviolet, etc.) from zone 2 is directed to color converting layer 135. Photon 138 interacts with a wavelength converting material in color converting layer 135 and is converted to a Lambertian emission of color converted light (e.g., green light). By minimizing the content of red-emitting phosphor in color converting layer 135, the probability is increased that the back reflected red and green light will be reflected once again toward the output window 108 without absorption by another wavelength converting material. Similarly, a photon 137 generated by an LED (e.g., blue, violet, ultraviolet, etc.) from zone 1 is directed to color converting layer 172. Photon 137 interacts with a wavelength converting material in color converting layer 172 and is converted to a Lambertian emission of color converted light (e.g., red light). By minimizing the content of green-emitting phosphor in color converting layer 172, the probability is increased that the back reflected red light will be reflected once again toward the output window 108 without reabsorption.

In another embodiment, LEDs 102 positioned in zone 2 of FIG. 6 are ultraviolet emitting LEDs, while LEDs 102 positioned in zone 1 of FIG. 6 are blue emitting LEDs. Color converting layer 172 includes any of a yellow-emitting phosphor and a green-emitting phosphor. Color converting layer 135 includes a red-emitting phosphor. The yellow and/or green emitting phosphors included in sidewall 107 are selected to have narrowband absorption spectra centered near the emission spectrum of the blue LEDs of zone 1, but far away from the emission spectrum of the ultraviolet LEDs of zone 2. In this manner, light emitted from LEDs in zone 2 is preferentially directed to output window 108, and undergoes conversion to red light. In addition, any amount of light emitted from the ultraviolet LEDs that illuminates sidewall 107 results in very little color conversion because of the insensitivity of these phosphors to ultraviolet light. In this manner, the contribution of light emitted from LEDs in zone 2 to combined light 140 is almost entirely red light. In this manner, the amount of red light contribution to combined light 140 can be influenced by current supplied to LEDs in zone 2. Light emitted from blue LEDs positioned in zone 1 is preferentially directed to sidewall 107 and results in conversion to green and/or yellow light. In this manner, the contribution of light emitted from LEDs in zone 1 to combined light 140 is a combination of blue and yellow and/or green light. Thus, the amount of blue and yellow and/or green light contribution to combined light 140 can be influenced by current supplied to LEDs in zone 1.

To achieve desired dimming characteristics, current may be selectively routed to LEDs in zones 1 and 2. For example, at 2900K, the LEDs in zone 1 may operate at maximum current levels with no current supplied to LEDs in zone 2. To reduce the color temperature, the current supplied to LEDs in zone 1 may be reduced while the current supplied to LEDs in zone 2 may be increased. Since the number of LEDs in zone 2 is less than the number in zone 1, the total relative flux of LED based illumination module 100 is reduced. Because LEDs in zone 2 contribute red light to combined light 140, the relative contribution of red light to combined light 140 increases. At 1900K, the current supplied to LEDs in zone 1 is reduced to a very low level or zero and the dominant contribution to combined light comes from LEDs in zone 2. To further reduce the output flux of LED based illumination module 100, the current supplied to LEDs in zone 2 is reduced with little or no change to the current supplied to LEDs in zone 1. In this operating region, combined light 140 is dominated by light supplied by LEDs in zone 2. For this reason, as the current supplied to LEDs in zone 2 is reduced, the color temperature remains roughly constant (1900K in this example).

Figure 7:
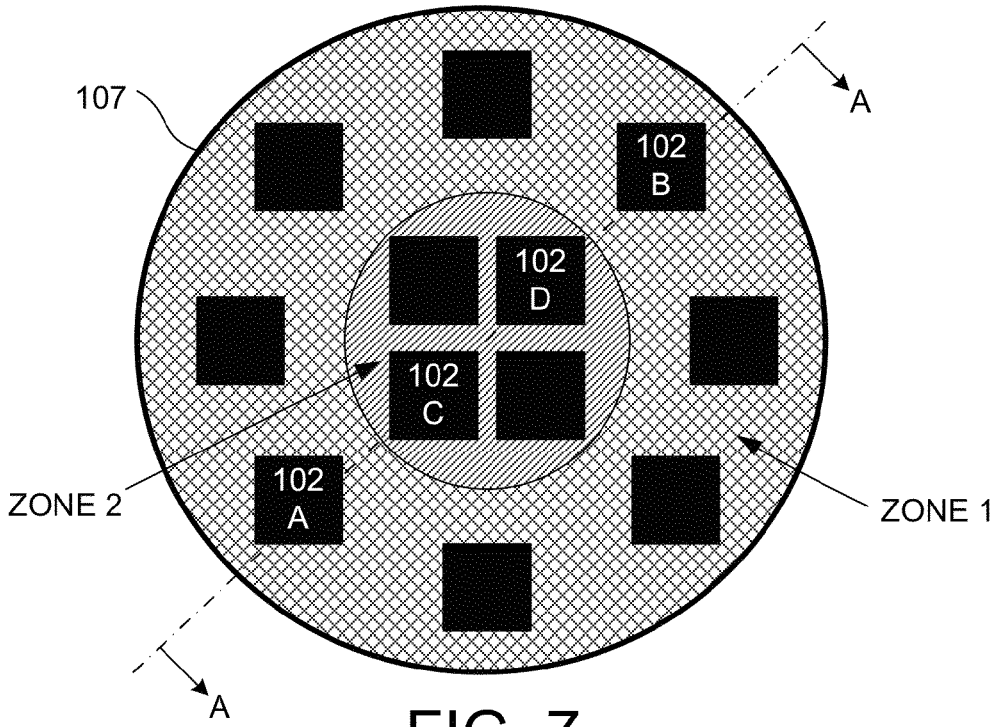
FIGS. 7 and 8 are illustrative top views of possible configurations of the zones in the LED based illumination module depicted in FIG. 6.
Figure 8:
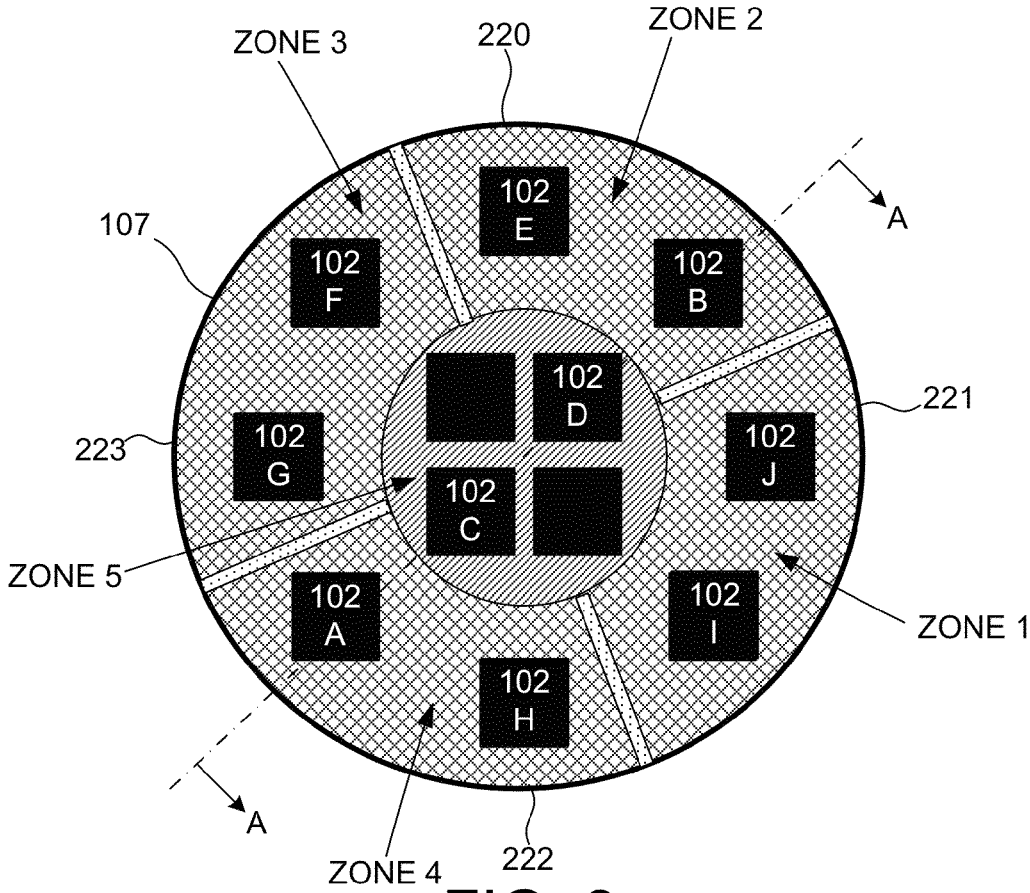

FIG. 7 is illustrative of a top view of LED based illumination module 100 depicted in FIG. 6. Section A depicted in FIG. 7 is the cross-sectional view depicted in FIG. 6. As depicted, in this embodiment, LED based illumination module 100 is circular in shape as illustrated in the exemplary configurations depicted in FIG. 2 and FIG. 3. In this embodiment, LED based illumination module 100 is divided into annular zones (e.g., zone 1 and zone 2) that include different groups of LEDs 102. As illustrated, zones 1 and zones 2 are separated and defined by their relative proximity to sidewall 107. Although, LED based illumination module 100, as depicted in FIGS. 7 and 8, is circular in shape, other shapes may be contemplated. For example, LED based illumination module 100 may be polygonal in shape. In other embodiments, LED based illumination module 100 may be any other closed shape (e.g., elliptical, etc.). Similarly, other shapes may be contemplated for any zones of LED based illumination module 100.

As depicted in FIG. 7, LED based illumination module 100 is divided into two zones. However, more zones may be contemplated. For example, as depicted in FIG. 8, LED based illumination module 100 is divided into five zones. Zones 1-4 subdivide sidewall 107 into a number of distinct color converting surfaces. In this manner light emitted from LEDs 1021 and 102J in zone 1 is preferentially directed to color converting surface 221 of sidewall 107, light emitted from LEDs 102B and 102E in zone 2 is preferentially directed to color converting surface 220 of sidewall 107, light emitted from LEDs 102F and 102G in zone 3 is preferentially directed to color converting surface 223 of sidewall 107, and light emitted from LEDs 102A and 102H in zone 4 is preferentially directed to color converting surface 222 of sidewall 107. The five zone configuration depicted in FIG. 8 is provided by way of example. However, many other numbers and combinations of zones may be contemplated.

In one embodiment, color converting surfaces zones 221 and 223 in zones 1 and 3, respectively may include a densely packed yellow and/or green emitting phosphor, while color converting surfaces 220 and 222 in zones 2 and 4, respectively, may include a sparsely packed yellow and/or green emitting phosphor. In this manner, blue light emitted from LEDs in zones 1 and 3 may be almost completely converted to yellow and/or green light, while blue light emitted from LEDs in zones 2 and 4 may only be partially converted to yellow and/or green light. In this manner, the amount of blue light contribution to combined light 140 may be controlled by independently controlling the current supplied to LEDs in zones 1 and 3 and to LEDs in zones 2 and 4. More specifically, if a relatively large contribution of blue light to combined light 140 is desired, a large current may be supplied to LEDs in zones 2 and 4, while a current supplied to LEDs in zones 1 and 3 is minimized. However, if relatively small contribution of blue light is desired, only a limited current may be supplied to LEDs in zones 2 and 4, while a large current is supplied to LEDs in zones 1 and 3. In this manner, the relative contributions of blue light and yellow and/or green light to combined light 140 may be independently controlled. This may be useful to tune the light output generated by LED based illumination module 100 to match a desired dimming characteristic. The aforementioned embodiment is provided by way of example. Many other combinations of different zones of independently controlled LEDs preferentially illuminating different color converting surfaces may be contemplated to a desired dimming characteristic.

In some embodiments, the locations of LEDs 102 within LED based illumination module 100 are selected to achieve uniform light emission properties of combined light 140. In some embodiments, the location of LEDs 102 may be symmetric about an axis in the mounting plane of LEDs 102 of LED based illumination module 100. In some embodiments, the location of LEDs 102 may be symmetric about an axis perpendicular to the mounting plane of LEDs 102. Light emitted from some LEDs 102 is preferentially directed toward an interior surface or a number of interior surfaces and light emitted from some other LEDs 102 is preferentially directed toward another interior surface or number of interior surfaces of color conversion cavity 160. The proximity of LEDs 102 to sidewall 107 may be selected to promote efficient light extraction from color conversion cavity 160 and uniform light emission properties of combined light 140. In such embodiments, light emitted from LEDs 102 closest to sidewall 107 is preferentially directed toward sidewall 107. However, in some embodiments, light emitted from LEDs close to sidewall 107 may be directed toward output window 108 to avoid an excessive amount of color conversion due to interaction with sidewall 107. Conversely, in some other embodiments, light emitted from LEDs distant from sidewall 107 may be preferentially directed toward sidewall 107 when additional color conversion due to interaction with sidewall 107 is necessary.

Figure 9:
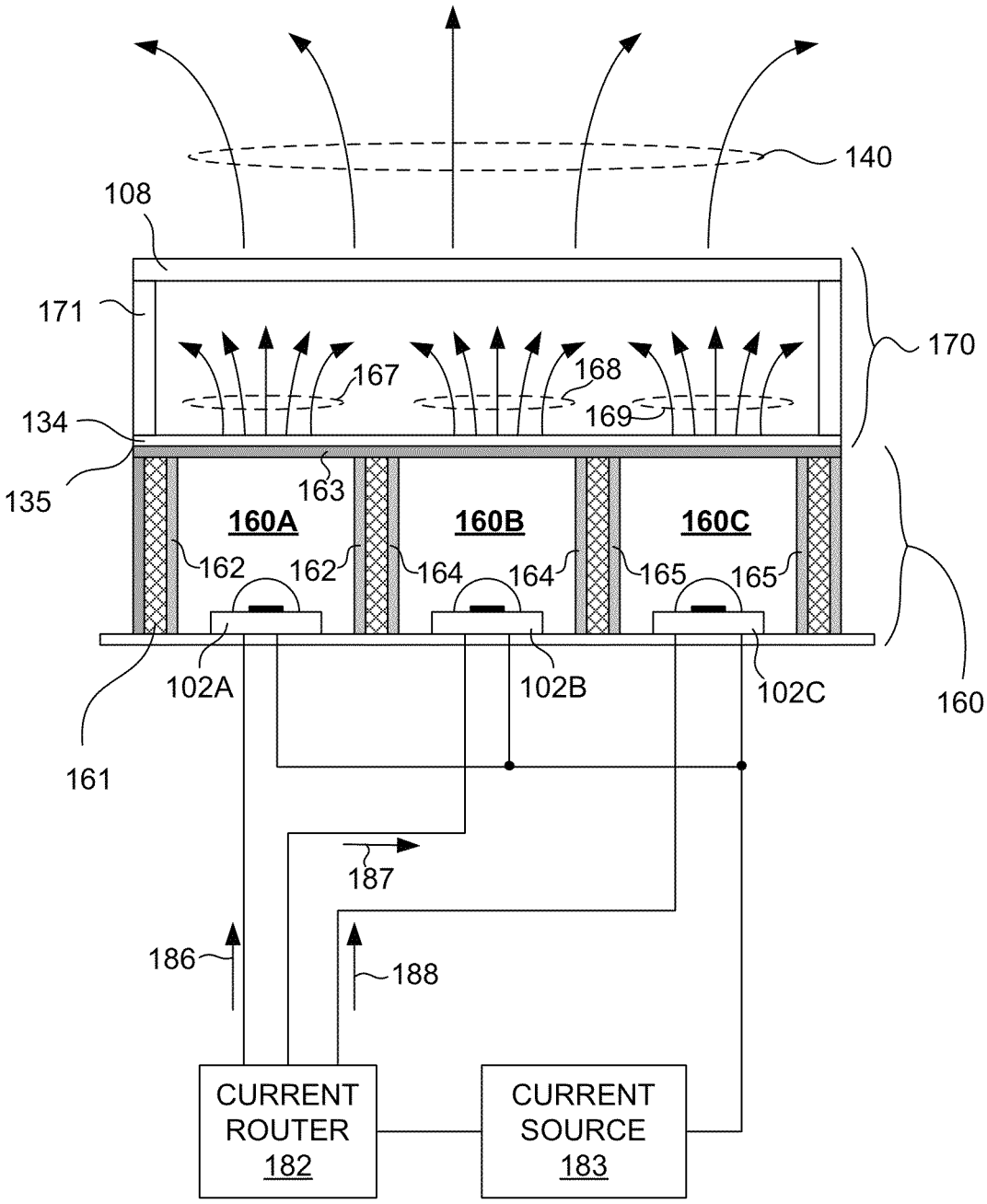
FIG. 9 is illustrative of a cross-sectional, side view of an LED based illumination module with LEDs coupled in series in different color conversion cavities and separately controlled by a current source and current router.

FIG. 9 depicts another embodiment operable to tune the color of light emitted from an LED based illumination module 100 that includes a number of color conversion cavities. By selectively routing the current supplied to different LEDs 102, the flux emitted from each color conversion cavity can be determined. In this manner, the output flux of color conversion cavities with different color converting characteristics can be tuned such that the color of light emitted from LED based illumination module 100 matches a target color point.

For example, current source 183 supplies current signal 209 to current router 182. Based on the switching period of current signal 209, current router selectively routes current signal 209 among current 186 supplied to LED 102A, current 187 supplied to LED 102B, and current 188 supplied to LED 102C. Light emitted from LED 102A enters color conversion cavity 160A, undergoes color conversion, and is emitted as color converted light 167. Similarly, light emitted from LEDs 102B and 102C enters color conversion cavities 160B and 160C, respectively, undergoes color conversion, and is emitted as color converted light 168 and 169, respectively. By adjusting currents 186, 187, and 188, the flux of each color converted light 167, 168, and 169 are tuned such that the combination of light 167, 168, and 169 matches a target color point. Similarly, additional color conversion cavities may be utilized to tune the color point of output light of LED based illumination module 100.

LED based illumination module 100 includes a number of color conversion cavities 160. Each color conversion cavity (e.g., 160*a*, 160*b*, and 160*c*) is configured to color convert light emitted from each LED (e.g., 102*a*, 102*b*, 102*c*), respectively, before the light from each color conversion cavity is combined. By altering any of the chemical composition of each CCC, the current supplied to any LED emitting into each CCC, and the shape of each CCC the color of light emitted from LED based illumination module 100 may be controlled and output beam uniformity improved.

As depicted in FIG. 9, LED 102A emits light directly into color conversion cavity 160A only. Similarly, LED 102B emits light directly into color conversion cavity 160B only and LED 102C emits light directly into color conversion cavity 160C only. Each LED is isolated from the others by a reflective sidewall. For example, as depicted, reflective sidewall 161 separates LED 102A from 102B.

Reflective sidewall 161 is highly reflective so that, for example, light emitted from a LED 102B is directed upward in color conversion cavity 160B generally towards the output window 108 of illumination module 100. Additionally, reflective sidewall 161 may have a high thermal conductivity, such that it acts as an additional heat spreader. By way of example, the reflective sidewall 161 may be made with a highly thermally conductive material, such as an aluminum based material that is processed to make the material highly reflective and durable. By way of example, a material referred to as Miro®, manufactured by Alanod, a German company, may be used. High reflectivity may be achieved by polishing the aluminum, or by covering the inside surface of reflective sidewall 161 with one or more reflective coatings. Reflective sidewall 161 might alternatively be made from a highly reflective thin material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In other examples, reflective sidewall 161 may be made from a PTFE material. In some examples reflective sidewall 161 may be made from a PTFE material of one to two millimeters thick, as sold by W.L. Gore (USA) and Berghof (Germany). In yet other embodiments, reflective sidewall 161 may be constructed from a PTFE material backed by a thin reflective layer such as a metallic layer or a non-metallic layer such as ESR, E60L, or MCPET. Also, highly diffuse reflective coatings can be applied to reflective sidewall 161. Such coatings may include titanium dioxide (TiO2), zinc oxide (ZnO), and barium sulfate (BaSO4) particles, or a combination of these materials.

In one aspect LED based illumination module 100 includes a first color conversion cavity (e.g., 160A) with an interior surface area coated with a first wavelength converting material 162 and a second color conversion cavity (e.g., 160B) with an interior surface area coated with a second wavelength converting material 164. In some embodiments, the LED based illumination module 100 includes a third color conversion cavity (e.g., 160C) with an interior surface area coated with a third wavelength converting material 165. In some other embodiments, the LED based illumination module 100 may include additional color conversion cavities including additional, different wavelength converting materials. In some embodiments, a number of color conversion cavities include an interior surface area coated with the same wavelength converting material.

As depicted in FIG. 9, in one embodiment, LED based illumination module 100 also includes a transmissive layer 134 mounted above the color conversion cavities 160. In some embodiments, transmissive layer 134 is coated with a color converting layer 135 that includes a wavelength converting material 163. In one example, wavelength converting materials 162, 164, and 165 may include red emitting phosphor materials and wavelength converting material 163 includes yellow emitting phosphor materials. Transmissive layer 134 promotes mixing of light output by each of the color conversion cavities.

In some examples, each wavelength conversion material included in color conversion cavities 160 and color converting layer 135 is selected such that a color point of combined light 140 emitted from LED based illumination module 100 matches a target color point.

In some embodiments, a secondary mixing cavity 170 is mounted above the color conversion cavities 160. Secondary mixing cavity 170 is a closed cavity that promotes the mixing of the light output by the color conversion cavities 160 such that combined light 140 emitted from LED based illumination module 100 as combined light 140 is uniform in color. As depicted in FIG. 9, secondary mixing cavity 170 includes a reflective sidewall 171 mounted along the perimeter of color conversion cavities 160 to capture the light output by the color conversion cavities 160. Secondary mixing cavity 170 includes an output window 108 mounted above the reflective sidewall 171. Light emitted from the color conversion cavities 160 reflects off of the interior facing surfaces of the secondary color conversion cavity and exit the output window 108 as combined light 140.

Figure 10:
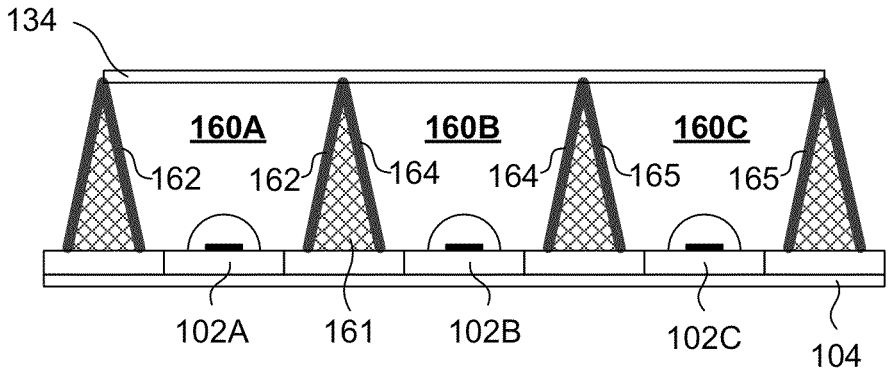
FIGS. 10 and 11 depict embodiments of the reflective sidewall in the LED based illumination module of FIG. 9.

As depicted in FIG. 9, LEDs 102 are mounted in a plane and reflective sidewall 161 includes flat surfaces oriented perpendicular to the plane upon which LEDs 102 are mounted. Flat, vertically oriented surfaces have been found to efficiently color convert light while minimizing back reflection. However, other surface shapes and orientations may be considered as well. For example, FIG. 10 depicts reflective sidewall 161 including flat surfaces oriented at an oblique angle with respect to the plane upon which LEDs 102 are mounted. In some examples, this configuration promotes light extraction from the color conversion cavities 160.

Figure 11:
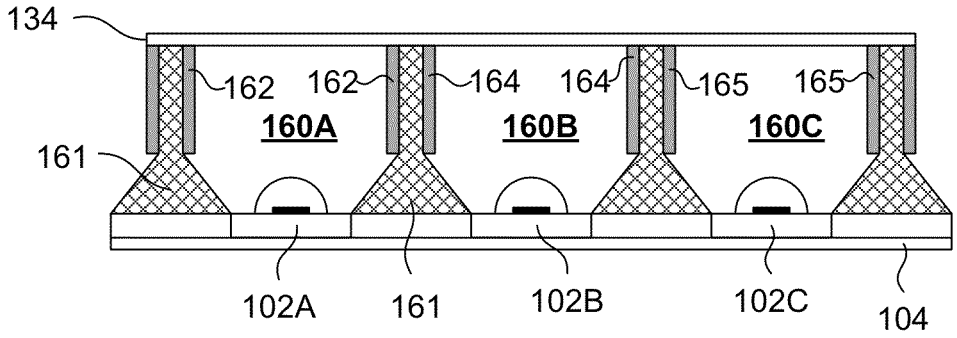

FIG. 11 depicts reflective sidewall 161 in another embodiment. As depicted, reflective sidewall 161 includes a tapered portion that includes a flat surface oriented at an oblique angle with respect to the plane upon which the LEDs 102 are mounted. The tapered portion transitions to a flat surface oriented perpendicular to the plane upon which the LEDs 102 are mounted. In other embodiments, the tapered portion includes a curved surface that transitions to the flat, vertically oriented surface. In some examples, these embodiments promote light extraction from the color conversion cavities 160 while efficiently color converting light emitted from the LEDs 102. Also, as depicted in FIG. 11, wavelength converting material (e.g., wavelength converting materials 162, 164, and 165) are disposed on the flat, vertically oriented surfaces of reflective sidewalls 161.

As discussed above, the color of light emitted from an LED based illumination module 100 that includes a number of color conversion cavities can be tuned to match a target color point by selecting each wavelength conversion material included in the color conversion cavities 160 and by selection of a wavelength converting material included in color converting layer 135. In other embodiments, the color of light emitted from the LED based illumination module 100 may be tuned by selecting LEDs 102 with a different peak emission wavelength. For example, LED 102A may be selected to have a peak emission wavelength of 480 nanometers, while LED 102B may be selected to have a peak emission wavelength of 460 nanometers.

Figure 12:
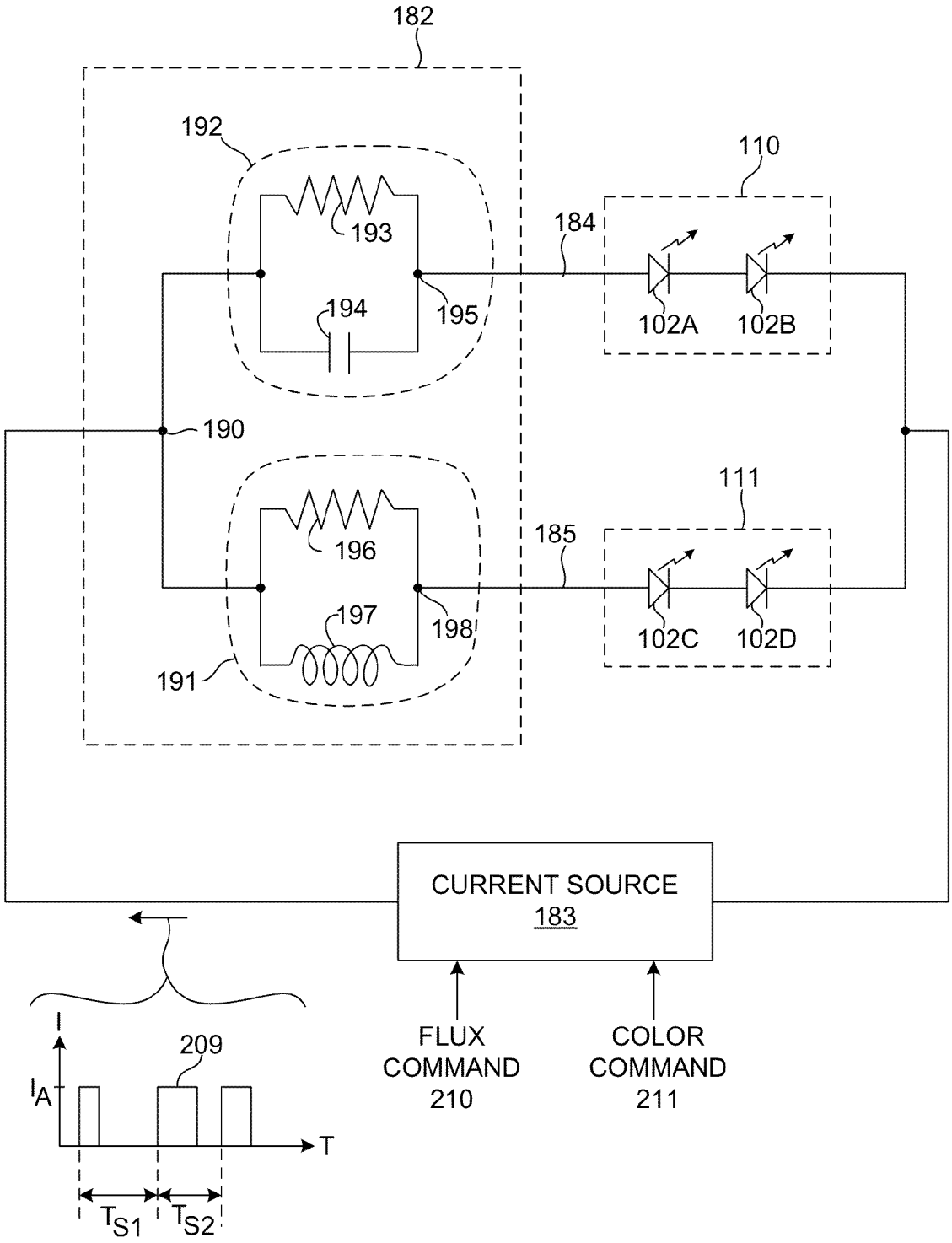
FIG. 12 illustrates an embodiment of a current router operable to selectively route current among multiple LED strings.

FIG. 12 illustrates current router 182 operable to selectively route current among multiple LED strings in one embodiment. In the depicted embodiment current router 182 includes a filter 192, e.g., including a parallel resistor 193 and capacitor 194, with a high pass characteristic coupled between output node 195 and input node 190 and a filter 191, e.g., including a parallel resistor 196 and inductor 197, with a low pass characteristic coupled between output node 198 and input node 190. LED string 110 is coupled to node 195 and LED string 111 is coupled to node 198. Current signal 209 received by current router 182 is selectively routed between LED string 110 and LED string 111 based on the relative impedance exhibited by low pass filter 191 and high pass filter 192 in response to input signal 209. For example, as the switching period increases, the periodic character of input signal 209 decreases in frequency. In response to this lower frequency, the impedance of low pass filter 191 decreases relative to the impedance of high pass filter 192. As a consequence, a larger proportion of input current signal 209 is routed through LED string 111 than LED string 110. Conversely, as the switching period decreases, the periodic character of input signal 209 increases in frequency. In response to this higher frequency, the impedance of low pass filter 191 increases relative to the impedance of high pass filter 192. As a consequence, a larger proportion of input current signal 209 is routed through LED string 110 than LED string 111. In this manner, the CCT of combined light 140 emitted from LED based illumination module 100 may be adjusted by current router 182 based on the frequency content of input signal 209.

In the depicted embodiment, current router 182 is a passive electrical implementation with relatively few, basic electrical components that may, for example, be implemented directly on LED mounting board 104. In some other embodiments, current router 182 may be implemented separately from LED mounting board 104. In some embodiments, a current router 182 may be implemented as a separate component part of LED based illumination module. In some embodiments, current router 182 may be implemented as part of current source 183.

Figure 13:
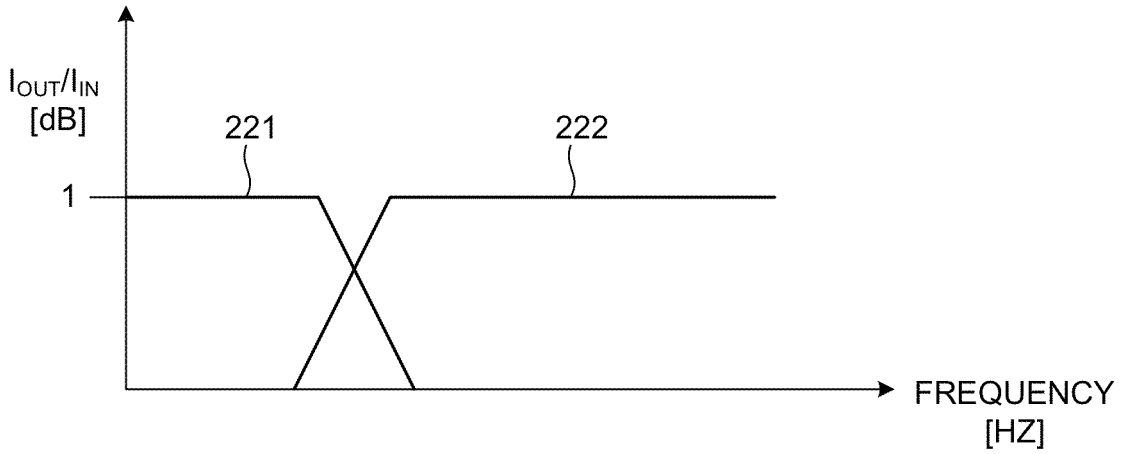
FIG. 13 illustrates the idealized high pass and low pass filter characteristics of the current router of FIG. 12.
Figure 14:
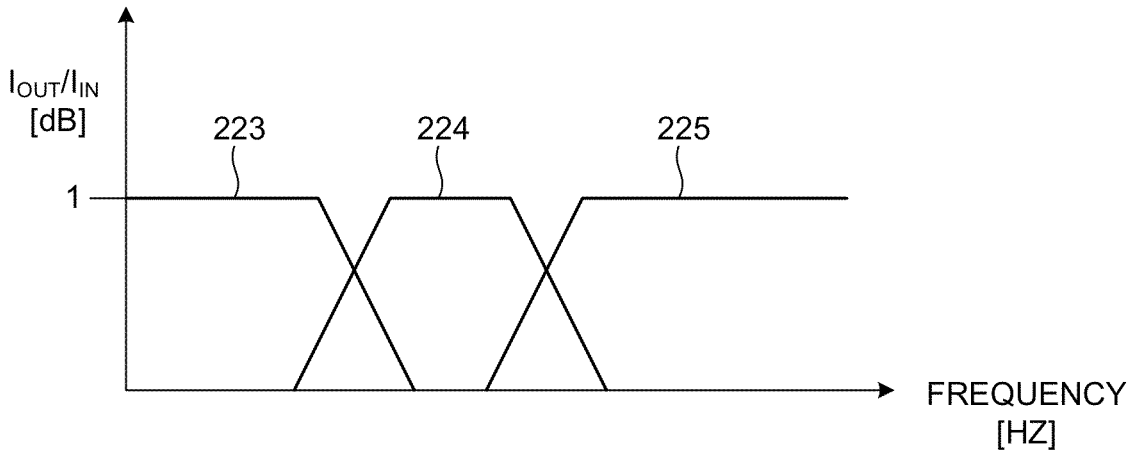
FIG. 14 illustrates a high pass, band pass, and low pass filter characteristics that may be possible with an embodiment of the current router.

In the depicted embodiment, current router 182 includes filter 192 with an idealized high pass filter characteristic 222 and filter 191 with an idealized low pass filter characteristic 221, both illustrated in FIG. 13. In other embodiments, current router 182 may include higher order filters (e.g., Butterworth, Chebyshev, etc.) that more accurately approximate the idealized filter characteristics illustrated in FIG. 13. In some other embodiments, current router 182 may selectively route current from a single current source to more than two LED strings. In these embodiments, each filter coupled to each LED string may exhibit a different frequency response characteristic. For example, as illustrated in FIG. 14, a first filter coupled to a first LED string may exhibit a low pass filter characteristic 223, a second filter coupled to a second LED string may exhibit a bandpass filter characteristic 224, and a third filter coupled to a third LED string may exhibit a high pass filter characteristic 225. Other combinations of filters may be contemplated. For example, the frequency response characteristics of different filters associated with different LED strings may overlap or be separated such that desired color characteristics of combined light 140 are achieved.

Figure 15:
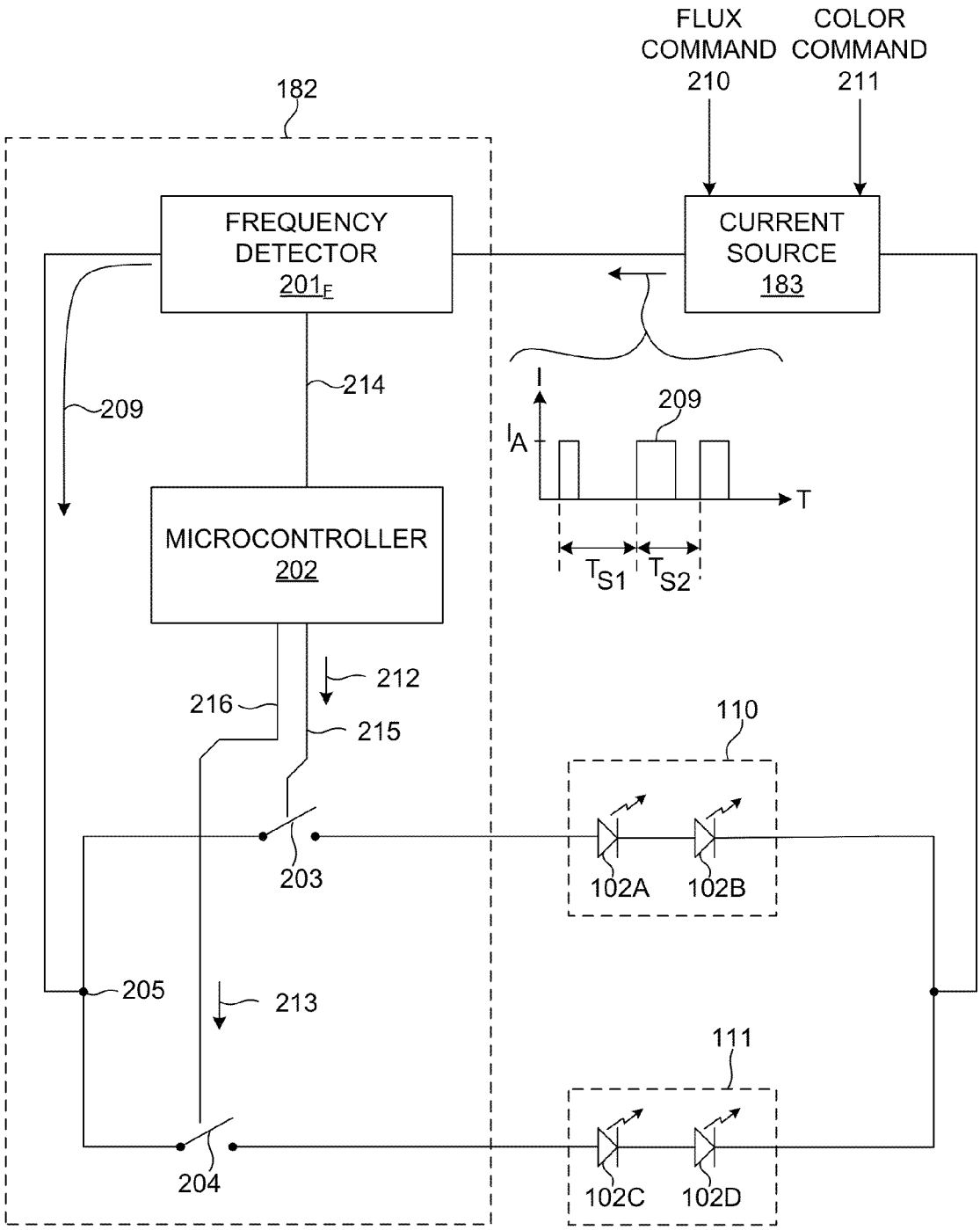
FIG. 15 illustrates another embodiment of a current router operable to selectively route current among multiple LED strings using a microcontroller.

FIG. 15 illustrates current router 182 in another embodiment. In the depicted embodiment, current router 182 includes switching element 203, switching element 204, frequency detector $\mathbf{201}_F$, and microcontroller 202. Switching element 203 (e.g., bipolar transistor) is coupled to LED string 110 and switching element 204 is coupled to LED string 111. Both switching elements 203 and 204 are coupled to current source 183 at node 205. frequency detector $\mathbf{201}_F$ determines the switching period of current signal 209 at a given time and communicates an indication of the switching period to microcontroller 202 over conductor 214. For example, frequency detector $\mathbf{201}_F$ may include a counter that starts on a rising edge and resets on a subsequent rising edge. The number of counts may be communicated to microcontroller 202 over conductor 214.

Microcontroller 202 determines a control signal 212 and a control signal 213 based on the switching period. Control signal 212 is communicated over conductor 215 to switching element 203. Based on the value of the control signal 212, switching element 203 becomes substantially conductive (e.g., closed state) or becomes substantially non-conductive (e.g., open state). Similarly, control signal 213 is communicated over conductor 216 to switching element 204. Based on the value of the control signal 213, switching element 204 becomes substantially conductive (i.e., closed state) or becomes substantially non-conductive (i.e., open state). In this manner, microcontroller 202 controls the flow of current through LED strings 110 and 111 based on the switching frequency of current signal 209.

In one embodiment, microcontroller 202 controls the flow of current through LED strings 110 and 111 in a PWM mode. In one example, microcontroller 202 refreshes control signals 212 and 213 every clock cycle. Average current is controlled by adjusting the duty cycle associated with each LED string in accordance with a look-up table. FIG. 16 is illustrative of a look-up table 300 that may be employed to determine the duty cycle associated with each LED string as a function of the switching frequency of current signal 209. As illustrated, if the switching frequency of current signal 209 is determined by frequency detector $\mathbf{201}_F$ to be 5.1 kHz, microcontroller 202 determines that the duty cycle associated with LED string 110 should be 80% and the duty cycle associated with LED string 111 should be 50% based on interpolation of look-up table 300. In response, microcontroller 202 communicates control signal 213 to switching element 204 as illustrated in FIG. 17. Control signal 213 remains "on" for five consecutive clock cycles $T_{O2}$ and then communicates an "off" control signal for the subsequent five consecutive clock cycles of the switching period $T_S$. Thus, current to LED string 111 is delivered with a 50% duty cycle. Similarly, as illustrated in FIG. 18, microcontroller 202 communicates control signal 212 to switching element 203. As illustrated in FIG. 18, control signal 212 remains "on" for eight consecutive clock cycles $T_{O2}$ and then communicates an "off" signal for the subsequent two consecutive clock cycles of the switching period $T_S$. Thus, current to LED string 110 is delivered with an 80% duty cycle. The control signals 213 and 212 illustrated in FIGS. 17 and 18 are provided by way of example. Other schemes may be contemplated. For example, to achieve a 50% duty cycle, the control signal 213 may be toggled at every clock cycle.

In some embodiments, microcontroller 202 may be replaced by a comparator. In these embodiments, the comparator determines whether the number of counts determined by frequency detector $\mathbf{201}_F$ exceeds a threshold value. In one case, control signals 212 and 213 may result in switching element 203 being substantially conductive and switching element 204 being substantially non-conductive. In the other case, the values of control signals 212 and 213 are reversed and switching element 203 becomes substantially non-conductive and switching element 204 becomes substantially conductive.

In the depicted embodiments, current router 182 is located between current source 183 and LED strings 110 and 111 on the supply side of the current loop. However, current router 182 may also be located between current source 183 and LED strings 110 and 111 on the return side of the current loop.

Figure 19:
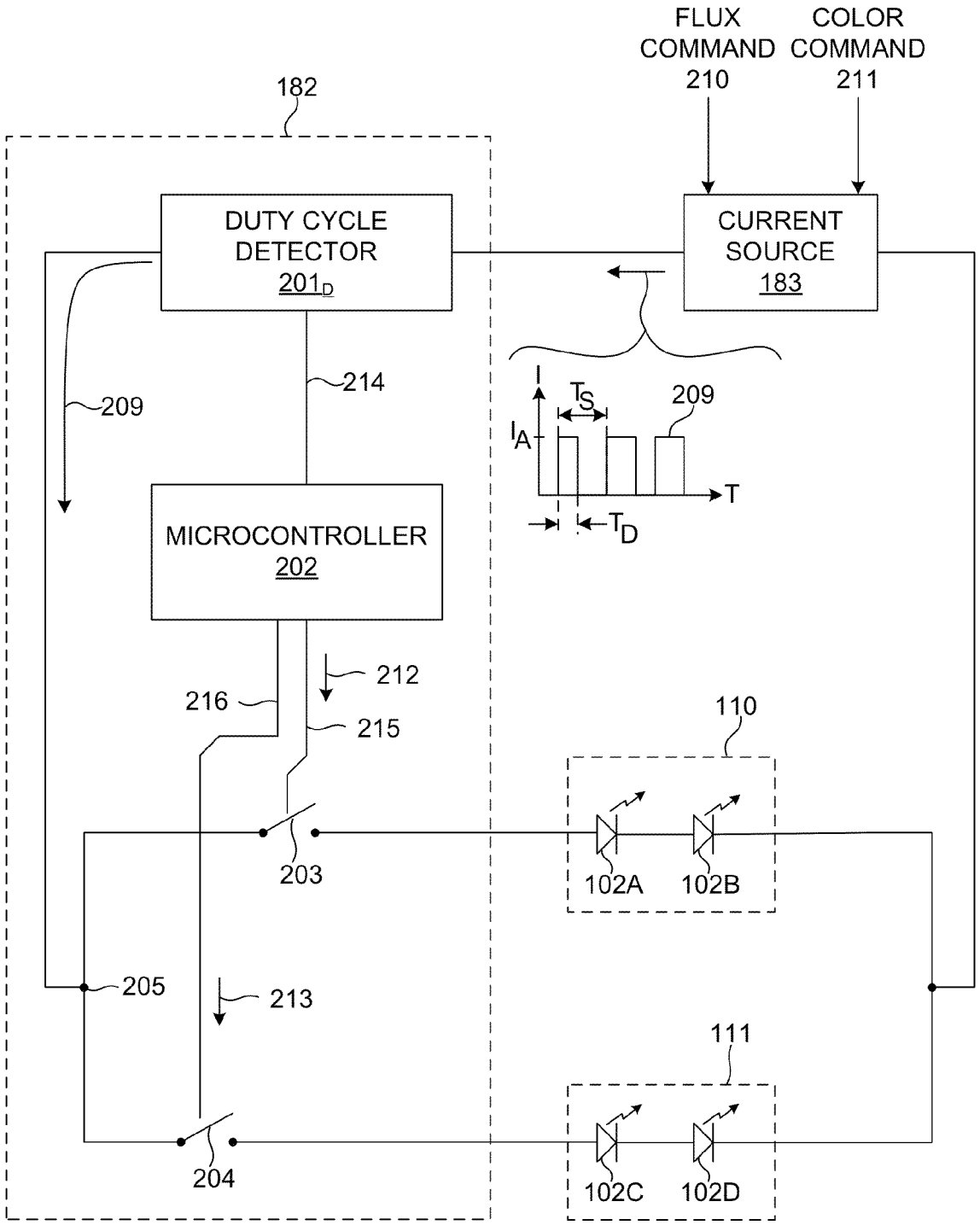
FIG. 19 illustrates another embodiment of a current router operable to selectively route current among multiple LED strings using a microcontroller.

FIG. 19 illustrates current router 182 in another embodiment. In the depicted embodiment, current router 182 includes switching element 203, switching element 204, duty cycle detector $\mathbf{201}_D$, and microcontroller 202. Switching element 203 (e.g., bipolar transistor) is coupled to LED string 110 and switching element 204 is coupled to LED string 111. Both switching elements 203 and 204 are coupled to current source 183 at node 205. duty cycle detector $\mathbf{201}_D$ determines the duty cycle of PWM current signal 209 at a given time and communicates an indication of the duty cycle to microcontroller 202 over conductor 214. For example, duty cycle detector $\mathbf{201}_D$ may include a counter that starts on a rising edge and resets on a subsequent trailing edge. The number of counts may be communicated to microcontroller 202 over conductor 214.

Microcontroller 202 determines a control signal 212 and a control signal 213 based on the duty cycle of current signal 209. Control signal 212 is communicated over conductor 215 to switching element 203. Based on the value of the control signal 212, switching element 203 becomes substantially conductive (e.g., closed state) or becomes substantially non-conductive (e.g., open state). Similarly, control signal 213 is communicated over conductor 216 to switching element 204. Based on the value of the control signal 213, switching element 204 becomes substantially conductive (i.e., closed state) or becomes substantially non-conductive (i.e., open state). In this manner, microcontroller 202 controls the flow of current through LED strings 110 and 111 based on the duty cycle of current signal 209.

Figure 20:
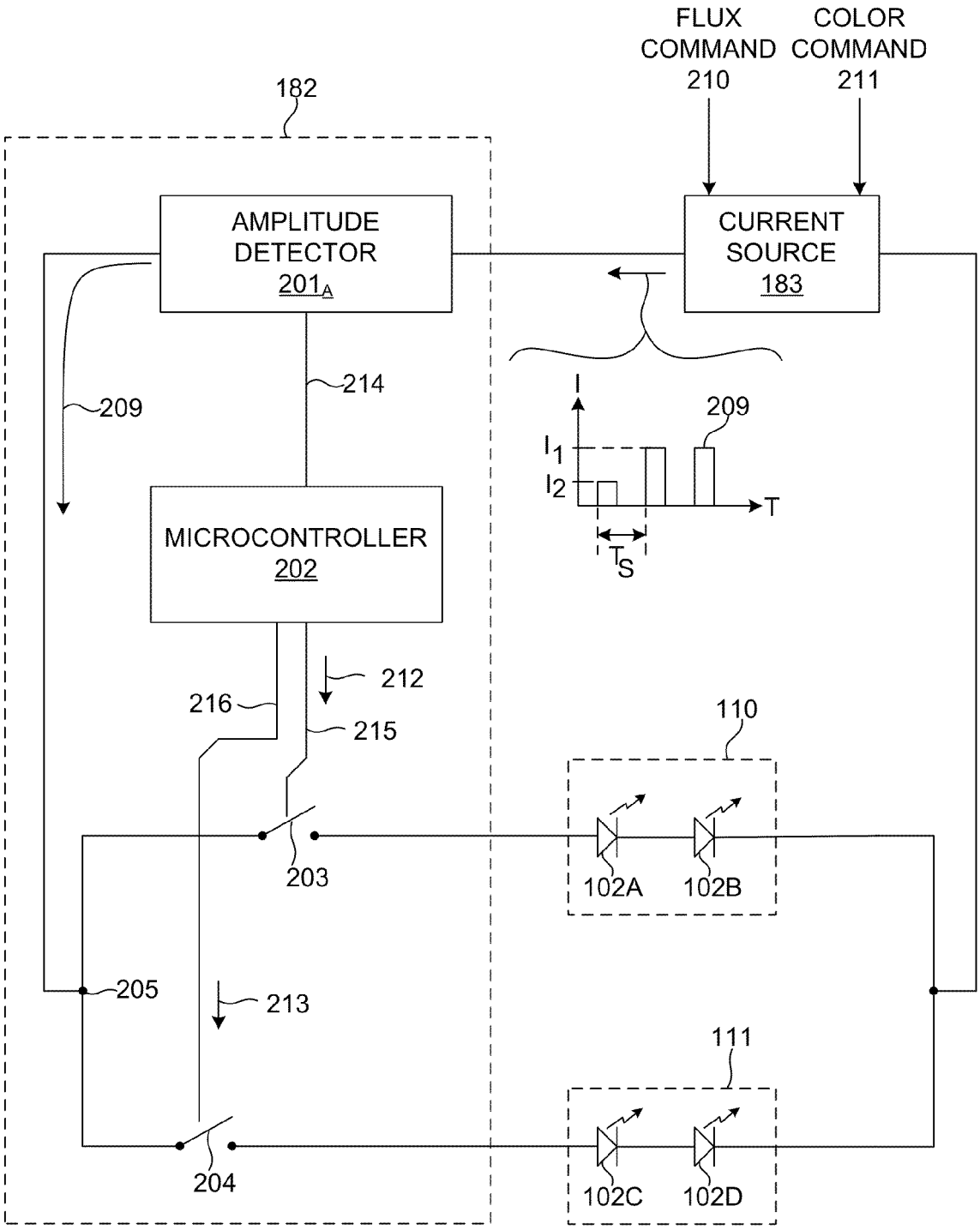
FIG. 20 illustrates another embodiment of a current router operable to selectively route current among multiple LED strings using a microcontroller.

FIG. 20 illustrates current router 182 in another embodiment. In the depicted embodiment, current router 182 includes switching element 203, switching element 204, amplitude detector $\mathbf{201}_A$, and microcontroller 202. Switching element 203 (e.g., bipolar transistor) is coupled to LED string 110 and switching element 204 is coupled to LED string 111. Both switching elements 203 and 204 are coupled to current source 183 at node 205. amplitude detector $\mathbf{201}_A$ determines the amplitude of current signal 209 for a given period of time and communicates an indication of the amplitude to microcontroller 202 over conductor 214. For example, amplitude detector $\mathbf{201}_A$ may include a peak detector that starts on a rising edge and resets on a subsequent rising edge. The peak amplitude may be communicated to microcontroller 202 over conductor 214. In another example, amplitude detector $\mathbf{201}_A$ is a current sensor that periodically updates and communicates a measured current value to microcontroller 202. This example may be advantageous when current signal 209 is a constant current signal.

Microcontroller 202 determines a control signal 212 and a control signal 213 based on the amplitude of current signal 209. Control signal 212 is communicated over conductor 215 to switching element 203. Based on the value of the control signal 212, switching element 203 becomes substantially conductive (e.g., closed state) or becomes substantially non-conductive (e.g., open state). Similarly, control signal 213 is communicated over conductor 216 to switching element 204. Based on the value of the control signal 213, switching element 204 becomes substantially conductive (i.e., closed state) or becomes substantially non-conductive (i.e., open state). In this manner, microcontroller 202 controls the flow of current through LED strings 110 and 111 based on the amplitude of current signal 209.

In another embodiment, each color conversion cavity 160 includes a transparent medium 210 with an index of refraction significantly higher than air (e.g., silicone). In some embodiments, transparent medium 210 fills the color conversion cavity. In some examples the index of refraction of transparent medium 210 is matched to the index of refraction of any encapsulating material that is part of the packaged LED 102. In the illustrated embodiment, transparent medium 210 fills a portion of each color conversion cavity, but is physically separated from the LED 102. This may be desirable to promote extraction of light from the color conversion cavity. As depicted, color converting layer 206 is disposed on transmissive layer 134. In some embodiments, color converting layer 206 includes multiple portions each with different wavelength converting materials. Although depicted as being disposed on top of transmissive layer 134 such that transmissive layer 134 lies between color converting layer 206 and each LED 102, in some embodiments, color converting layer 206 may be disposed on transmissive layer 134 between transmissive layer 134 and each LED 102. In addition, or alternatively, a wavelength converting material may be embedded in transparent medium 210.

In some embodiments, components of color conversion cavity 160 may be constructed from or include a PTFE material. In some examples the component may include a PTFE layer backed by a reflective layer such as a polished metallic layer. The PTFE material may be formed from sintered PTFE particles. In some embodiments, portions of any of the interior facing surfaces of color converting cavity 160 may be constructed from a PTFE material. In some embodiments, the PTFE material may be coated with a wavelength converting material. In other embodiments, a wavelength converting material may be mixed with the PTFE material.

In other embodiments, components of color conversion cavity 160 may be constructed from or include a reflective, ceramic material, such as ceramic material produced by CerFlex International (The Netherlands). In some embodiments, portions of any of the interior facing surfaces of color converting cavity 160 may be constructed from a ceramic material. In some embodiments, the ceramic material may be coated with a wavelength converting material.

In other embodiments, components of color conversion cavity 160 may be constructed from or include a reflective, metallic material, such as aluminum or Miro® produced by Alanod (Germany). In some embodiments, portions of any of the interior facing surfaces of color converting cavity 160 may be constructed from a reflective, metallic material. In some embodiments, the reflective, metallic material may be coated with a wavelength converting material.

In other embodiments, (components of color conversion cavity 160 may be constructed from or include a reflective, plastic material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In some embodiments, portions of any of the interior facing surfaces of color converting cavity 160 may be constructed from a reflective, plastic material. In some embodiments, the reflective, plastic material may be coated with a wavelength converting material.

Cavity 160 may be filled with a non-solid material, such as air or an inert gas, so that the LEDs 102 emits light into the non-solid material. By way of example, the cavity may be hermetically sealed and Argon gas used to fill the cavity. Alternatively, Nitrogen may be used. In other embodiments, cavity 160 may be filled with a solid encapsulate material. By way of example, silicone may be used to fill the cavity.

Although certain specific embodiments are described above for instructional purposes, the teachings of this patent document have general applicability and are not limited to the specific embodiments described above. For example, any component of color conversion cavity 160 may be patterned with phosphor. Both the pattern itself and the phosphor composition may vary. In one embodiment, the illumination device may include different types of phosphors that are located at different areas of a color conversion cavity 160. For example, a red phosphor may be located on either or both of the insert 107 and the bottom reflector insert 106 and yellow and green phosphors may be located on the top or bottom surfaces of the window 108 or embedded within the window 108. In one embodiment, different types of phosphors, e.g., red and green, may be located on different areas on the sidewalls 107. For example, one type of phosphor may be patterned on the sidewall insert 107 at a first area, e.g., in stripes, spots, or other patterns, while another type of phosphor is located on a different second area of the insert 107. If desired, additional phosphors may be used and located in different areas in the cavity 160. Additionally, if desired, only a single type of wavelength converting material may be used and patterned in the cavity 160, e.g., on the sidewalls. In another example, cavity body 105 is used to clamp mounting board 104 directly to mounting base 101 without the use of mounting board retaining ring 103. In other examples mounting base 101 and heat sink 130 may be a single component. In another example, LED based illumination module 100 is depicted in FIGS. 1-3 as a part of a luminaire 150. As illustrated in FIG. 3, LED based illumination module 100 may be a part of a replacement lamp or retrofit lamp. But, in another embodiment, LED based illumination module 100 may be shaped as a replacement lamp or retrofit lamp and be considered as such. In another embodiment, current router 182 may receive the current from the current source 183 but directly receive one or more of the flux command input signal 210 and the color command input signal 211. The current router 182 may then selectively route the current between LED strings 110 and 111 based on the directly received flux command input signal 210 and the color command input signal 211. Accordingly, various modifications, adaptations, and combinations of various features of the described embodiments can be practiced without departing from the scope of the invention as set forth in the claims.

What is claimed is:

1. An LED based illumination device, comprising:

a first LED string comprising a first plurality of LEDs coupled in series, wherein a first current supplied to the first LED string causes a light emission from the LED based illumination device with a first Correlated Color Temperature (CCT);

a second LED string comprising a second plurality of LEDs coupled in series, wherein the second current supplied to the second LED string causes a light emission from the LED based illumination device with a second CCT; and a current router comprising, a first node coupled to a current source, the current router operable to receive a current signal on the first node, a second node coupled to the first LED string, a third node coupled to the second LED string, the current router operable to selectively route a first portion of the current signal as the first current to the first LED string over the second node and a second portion of the current signal as the second current to the second LED string over the third node based on a property of the current signal.

2. The LED based illumination device of claim 1, wherein the current router routes the current signal to the first LED string and not to the second LED string when the property of the current signal is below a threshold value, and wherein the current router routes the current signal to the second LED string and not to the first LED string when the property of the current signal is above the threshold value.

3. The LED based illumination device of claim 1, wherein the first CCT is less than 3,000 Kelvin and the second CCT is greater than 3,000 Kelvin.

4. The LED based illumination device of claim 1, further comprising:

a first color conversion cavity with a first color converting property, wherein light emitted from the first plurality of LEDs is directed to the first color conversion cavity; and a second color conversion cavity with a second color converting property, wherein light emitted from the second plurality of LEDs is directed to the second color conversion cavity.

5. The LED based illumination device of claim 1, wherein a peak emission wavelength of a light emitted from the first plurality of LEDs is different from a peak emission wavelength of a light emitted from the second plurality of LEDs.

6. The LED based illumination device of claim 1, wherein the property of the current signal is a frequency of oscillation of the current signal.

7. The LED based illumination device of claim 1, wherein the property of the current signal is a switching frequency of the current signal.

8. The LED based illumination device of claim 1, wherein the current router comprises:

a first resistor coupled between the first node and the second node; and a capacitor coupled between the first node and the second node.

9. The LED based illumination device of claim 8, wherein the current router comprises:

an inductor coupled between the first node and the third node; and a second resistor coupled between the first node and the third node.

10. The LED based illumination device of claim 1, the current router comprising:

a frequency detector operable to determine a switching frequency of the current signal; and a microcontroller operable to generate a plurality of control signals based on a frequency of the current signal.

11. The LED based illumination device of claim 10, the current router further comprising:

a first switching element coupled to the first LED string, the first switching element having a substantially conductive state and a substantially non-conductive state, wherein a first value of a first control signal of the plurality of control signals causes the first switching element to be substantially conductive, and wherein a second value of the first control signal causes the first switching element be substantially non-conductive, and a second switching element coupled to the second LED string, the second switching element having a substantially conductive state and a substantially non-conductive state, wherein a first value of a second control signal of the plurality of control signals causes the second switching element to be substantially conductive, and wherein a second value of the second control signal causes the second switching element be substantially non-conductive.

12. An apparatus comprising:

a current source having a power input node, a color command input node, and a power output node, wherein the current source is operable to change a property of a current signal selected from a group consisting of switching frequency, duty cycle, and amplitude, generated by the current source on the power output node based on a color command input signal on the color command input node;

a current router having an input node, a first output node, and a second output node, the input node of the current router coupled to receive the current signal on the power output node of the current source, wherein the current router selectively routes a first portion of the current signal on the first output node and a second portion of the current signal on the second output node;

a first plurality of LEDs coupled in series between the first output node of the current router and the power input node of the current source, wherein the first portion of the current signal is supplied as a first current to the first plurality of LEDs; and a second plurality of LEDs coupled in series between the second output node of the current router and the power input node of the current source, wherein the second portion of the current signal is supplied as a second current to the second plurality of LEDs.

13. The apparatus of claim 12, wherein the current router changes the first current supplied to the first plurality of LEDs relative to the second current supplied to the second plurality of LEDs based on the property of the current signal generated by the current source.

14. The apparatus of claim 12, wherein the current router routes the current signal to the first plurality of LEDs and not to the second plurality of LEDs when the property of the current signal is below a threshold value, and wherein the current router routes the current signal to the second plurality of LEDs and not to the first plurality of LEDs when the property of the current signal is above the threshold value.

15. The apparatus of claim 12, an LED based illumination device generates light of a first correlated color temperature in response to light generated by the first plurality of LEDs and generates light of a second correlated color temperature in response to light generated by the second plurality of LEDs.

16. A current router, comprising:

a first node couplable to a single channel of a current source, wherein the current source is a switching power supply operable at a plurality of switching frequencies;

a second node couplable to a first LED string including a first plurality of LEDs coupled in series; and a third node couplable to a second LED string including a second plurality of LEDs coupled in series, wherein a current signal received by the current router over the first node is selectively routed to each of the first string of LEDs and the second string of LEDs based on a property selected from a group consisting of switching frequency, duty cycle, and amplitude of the switching power supply.

17. The current router of claim 16, wherein the first plurality of LEDs emit light with a first Correlated Color Temperature (CCT) into a color conversion cavity, and wherein the second plurality of LEDs emit light with a second CCT into the color conversion cavity.

18. A method comprising:

receiving a switched current signal having a property selected from a group consisting of switching frequency, duty cycle, and amplitude; and selectively routing a first portion of the switched current signal as a first current supplied to a first plurality of LEDs coupled in series and a second portion of the switched current signal as a second current supplied to a second plurality of LEDs coupled in series based on the property.

19. The method of claim 18, wherein the selectively routing involves, detecting the property of the switched current signal, comparing the property to a threshold value, communicating a first control signal to a first switching element coupled in series with the first plurality of LEDs based on the comparing of the property to the threshold value, and communicating a second control signal to a second switching element coupled in series with the second plurality of LEDs based on the comparing of the property to the threshold value.

20. The method of claim 18, wherein a peak emission wavelength of a light emitted from the first plurality of LEDs is different from a peak emission wavelength of a light emitted from the second plurality of LEDs.

21. The LED based illumination device of claim 1, wherein the current source produces the property of the current signal, the property selected from a group consisting of switching frequency, duty cycle, and amplitude.

* * * * *